US012578139B2

(12) United States Patent
Park

(10) Patent No.: US 12,578,139 B2
(45) Date of Patent: Mar. 17, 2026

(54) REFRIGERATOR

(71) Applicant: LG ELECTRONICS INC., Seoul (KR)

(72) Inventor: Hyungkyu Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 114 days.

(21) Appl. No.: 18/519,597

(22) Filed: Nov. 27, 2023

(65) Prior Publication Data

US 2024/0191933 A1 Jun. 13, 2024

(30) Foreign Application Priority Data

Dec. 12, 2022 (KR) ..... 10-2022-0172257

(51) Int. Cl.
*F25D 23/02* (2006.01)

(52) U.S. Cl.
CPC ..... *F25D 23/028* (2013.01); *F25D 2323/02* (2013.01)

(58) Field of Classification Search
None
See application file for complete search history.

(56) References Cited

U.S. PATENT DOCUMENTS 7,984,955 B2 * 7/2011 Jung ..... F25D 23/028 312/319.2
8,025,349 B2 * 9/2011 Lim ..... F25D 23/028 312/319.2
8,277,005 B2 * 10/2012 Jung ..... E05B 17/0033 312/319.2
8,328,301 B2 * 12/2012 Lee ..... E05B 17/0033 292/336.3
8,398,185 B2 3/2013 Seo
9,127,879 B2 * 9/2015 Hwang ..... F25D 23/00
9,506,685 B2 * 11/2016 Park ..... F25D 23/028
9,897,368 B2 * 2/2018 Lee ..... F25D 23/028
10,684,063 B2 * 6/2020 Querfurth ..... F25D 23/028
2011/0132024 A1 * 6/2011 Lim ..... E05B 17/0033 62/449

(Continued)

FOREIGN PATENT DOCUMENTS

CN 101892770 A 11/2010
CN 202083169 U 12/2011

(Continued)

*Primary Examiner* — Hanh V Tran
(74) *Attorney, Agent, or Firm* — Birch, Stewart, Kolasch & Birch, LLP

(57) ABSTRACT

A refrigerator includes a cabinet having a storage space; a door opening and closing the storage space and filled with an insulator therein; a cap decoration forming at least a portion of a circumferential surface of the door and having a recessed handle; and a door opening device provided on the door and operated by a user to open the door, in which the door opening device includes a case mounted on the cap decoration and forming a space independent of the insulator inside the door; and an operating member operably mounted inside the case, and a handle opening communicating with the case and the handle is formed in the cap decoration, and the operating member passes through the handle opening and extends into the handle.

18 Claims, 20 Drawing Sheets

(56) References Cited

U.S. PATENT DOCUMENTS

| | | | | |
|---|---|---|---|---|
| 2012/0280608 | A1* | 11/2012 | Park | E05B 1/0015 49/460 |
| 2023/0204278 | A1* | 6/2023 | Lim | F25D 23/028 16/412 |
| 2024/0125537 | A1* | 4/2024 | Lim | F25D 25/02 |

FOREIGN PATENT DOCUMENTS

| | | | | | |
|---|---|---|---|---|---|
| CN | 102661082 | B | | 10/2014 | |
| CN | 105466101 | A | | 4/2016 | |
| CN | 105466101 | B | * | 10/2018 | |
| JP | 2004116842 | A | * | 4/2004 | |
| JP | 2005337681 | A | * | 12/2005 | |
| JP | 3871474 | B2 | * | 1/2007 | |
| KR | 0182734 | B1 | * | 5/1999 | F25D 23/028 |
| KR | 0125619 | Y1 | * | 10/1999 | F25D 23/028 |
| KR | 2000-0034210 | A | | 6/2000 | |
| KR | 100281961 | B1 | * | 2/2001 | F25D 23/028 |
| KR | 20090008042 | U | * | 8/2009 | E05B 1/0053 |
| KR | 101937204 | B1 | * | 1/2019 | |
| WO | WO-2024237703 | A1 | * | 11/2024 | F25D 25/02 |
| WO | WO-2024237708 | A1 | * | 11/2024 | F25D 25/02 |

* cited by examiner

REFRIGERATOR

CROSS-REFERENCE TO RELATED APPLICATIONS

The present application claims the benefit under 35 U.S.C. § 119 of Korean Patent Application No. 10-2022-0172257, filed on Dec. 12, 2022, which is hereby incorporated by reference in its entirety.

BACKGROUND

The present disclosure relates to a refrigerator.

In general, a refrigerator is a home appliance that allows low-temperature storage of food in an internal storage space shielded by a door. To this end, the refrigerator is configured to cool the inside of the storage space using cool air generated through heat exchange with a refrigerant circulating in the refrigerating cycle, thereby storing stored food in an optimal state.

Recently, refrigerators are gradually becoming larger and more multi-functional in accordance with the trend of changing dietary habits and upgrading products, and refrigerators equipped with various structures and convenience devices that enable users' convenience and efficient use of internal space are being released.

The storage space of the refrigerator may be opened and closed by a door. Refrigerators may be classified into various types according to the disposition of the storage space and the structure of a door that opens and closes the storage space.

Typically, the door of the refrigerator may have a structure that is opened and closed by rotation or sliding. In addition, the handle may protrude or be recessed to open the door.

In addition, when the door is large and heavy, when a negative pressure is generated due to low temperature inside the refrigerator, because of magnetic force of the door gasket, or the like, a lot of force may be required to open the door, which may cause inconvenience to the user.

In order to solve such a problem, a device that facilitates a user's door opening has been developed.

SUMMARY

An object of an embodiment of the present disclosure is to provide a refrigerator in which a door opening device is disposed inside a handle of a recessed door to improve outer appearance.

An object of an embodiment of the present disclosure is to provide a refrigerator in which a door can be easily opened when a recessed handle is operated to open the door.

An object of the present disclosure is to provide a refrigerator capable of reinforcing strength while maintaining the outer appearance of an operating member of a door opening device.

A refrigerator according to an embodiment of the present disclosure may include a cabinet having a storage space; a door opening and closing the storage space and filled with an insulator therein; a cap decoration forming at least a portion of a circumferential surface of the door and having a recessed handle; and a door opening device provided on the door and operated by a user to open the door, in which the door opening device may include a case mounted on the cap decoration and forming a space independent of the insulator inside the door; and an operating member operably mounted inside the case, and in which a handle opening communicating with the case and the handle may be formed in the cap decoration, and the operating member may pass through the handle opening and extend into the handle.

The operating member may be shielded from the front by a door plate forming a front surface of the door.

The operating member may be located in the front with respect to the center of the handle.

The operating member may be mounted to be operated in a direction closer to the front surface of the door.

The handle opening may be opened toward the front and bottom surfaces of the door.

The operating member may be formed in a corresponding shape to shield the opening of the handle.

The operating member may be rotatably mounted to the case, and when the operating member rotates, the operating member may be inserted into the opening of the handle.

The door opening device may further include a push member that selectively protrudes to the rear of the door and pushes the front surface of the cabinet; an elastic member elastically supporting the push member; and a link in contact with the operating member and the push member to operate the push member when the operating member operates, and the operating member, the elastic member, the link and the push member may be mounted inside the case.

The operating member and the link may be rotatably mounted to the case, and a rotation shaft of the operating member and a rotation shaft of the link may be disposed side by side with each other.

The rear surface of the operating member may be exposed to the inside of the handle, and a supporter may be coupled to a front surface of the operating member, which is formed of a material having higher strength than the operating member and reinforces the strength of the operating member.

The supporter may include a supporter body supporting a front surface of the operating member; and a supporter rotation shaft protruding from the supporter body to be shaft-coupled to the case and serves as a rotational shaft of the operating member.

The supporter may include a supporter extension that extends further forward than the supporter rotation shaft to contact the link and rotates the link when the operating member rotates.

A plurality of reinforcing ribs may be formed on the supporter body, and the reinforcing ribs may be formed to cross each other.

The supporter may be formed in a metal rod shape and extend in the longitudinal direction of the operating member from one end to the other end of the operating member.

The supporter may be formed in a metal plate shape corresponding to the front surface of the operating member and support the front surface of the operating member.

The door opening device may include a push member selectively protruding to the rear of the door and contacts the cabinet; an elastic member elastically supporting the push member; a first link shaft-coupled to the case and moving the push member by rotation in a front and rear direction; and a second link formed of a different material from the operating member, coupled to the operating member, and serving as a rotation shaft of the operating member; and the second link may be in contact with the first link to transfer the rotational force of the operating member to the first link.

A supporter formed of a metal material to reinforce the strength of the operating member may be coupled to the operating member, and the supporter may include a first support portion for supporting a front surface of the operating member; and a second support portion bent at a lower end of the first support portion and supporting a lower surface of the second link.

A recessed forming portion may be formed in the supporter, and the forming portion may extend in an extension direction of the first support portion and the second support portion.

The refrigerator may further include a rail connecting the cabinet and the door to allow the door to be drawn in and out, in which the door may be a drawer-type door that is drawn out forward.

The refrigerator may further include a hinge device connecting the cabinet and the door to rotate the door, in which the door may be a rotary door.

In the refrigerator according to the proposed embodiment, the following effects can be expected.

The refrigerator according to the embodiment of the present disclosure is equipped with a door opening device, so that the door can be easily opened and the door opening device is not exposed, so that the outer appearance thereof can be improved.

In particular, since the operating member operated by the user is disposed inside the recessed handle, the door opening device including the operating member is not exposed when viewed from the front, thereby further improving the outer appearance thereof.

In addition, the operating member is disposed forward with respect to the center of the handle, so that when a user grasps the handle to open the door, the user can naturally operate the handle, thereby improving convenience of use.

Further, since the operating member rotates toward the front surface of the door and operates, the door can be easily opened with only one motion of holding and pulling the handle by the user, thereby further improving convenience of use.

In addition, the operating member that comes in contact with the user's hand may be formed of a material with excellent texture and may be formed of a material having a surface property that can harmonize with the inner surface of the handle, thereby improving the outer appearance and usability.

In addition, the operating member is provided with a supporter for reinforcing strength, so that durability can be guaranteed without being damaged or deformed while using the operating member with improved outer appearance and usability.

DETAILED DESCRIPTION OF THE EMBODIMENTS

Hereinafter, specific embodiments of the present disclosure will be described in detail with drawings. However, the present disclosure cannot be said to be limited to the embodiments in which the spirit of the present disclosure is presented, and other degenerative disclosures or other embodiments included in the scope of the present disclosure can be easily suggested by adding, changing, or deleting other components.

Define direction before description. In an embodiment of the present disclosure, the direction toward the door may be defined as a front direction based on the cabinet illustrated in FIG. 1, the direction toward the cabinet may be defined as a rear direction based on the door, the direction toward the floor where the refrigerator is installed may be defined as a lower direction, and the direction away from the floor may be defined as a upper direction.

Figure 1:
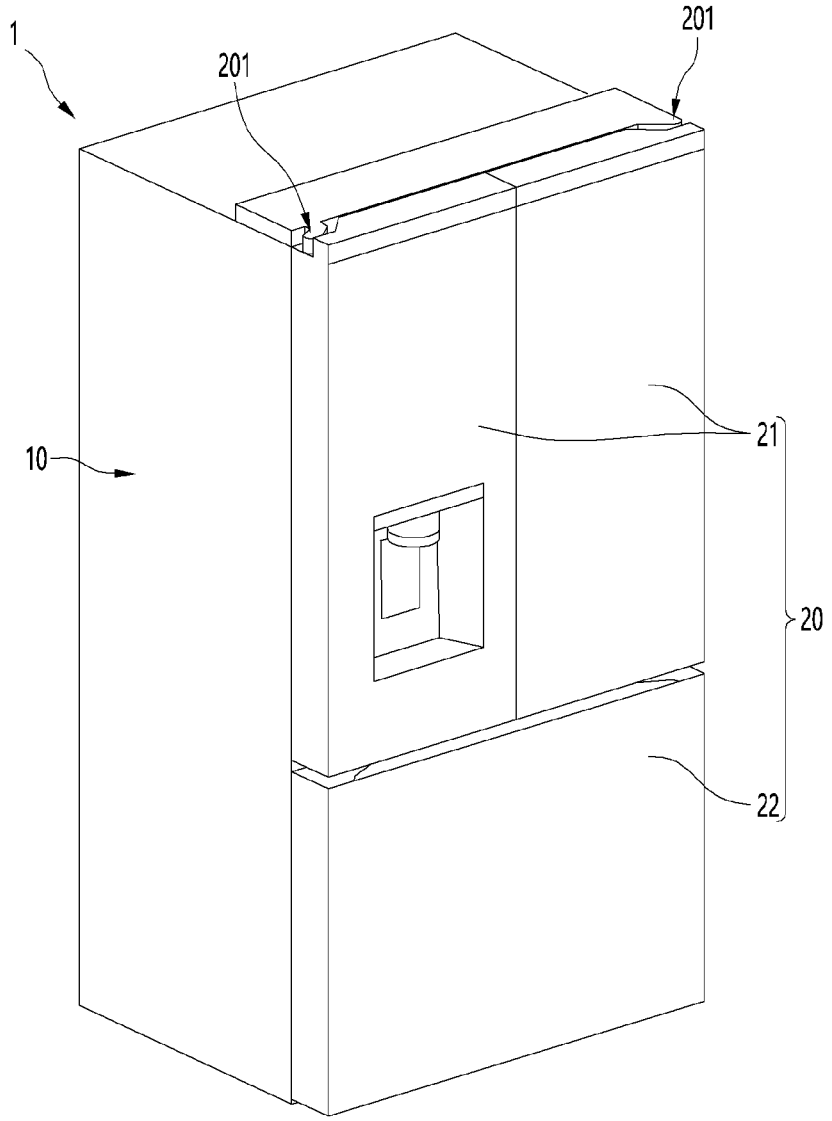
FIG. 1 is a perspective view illustrating a refrigerator according to a first embodiment of the present disclosure.
Figure 2:
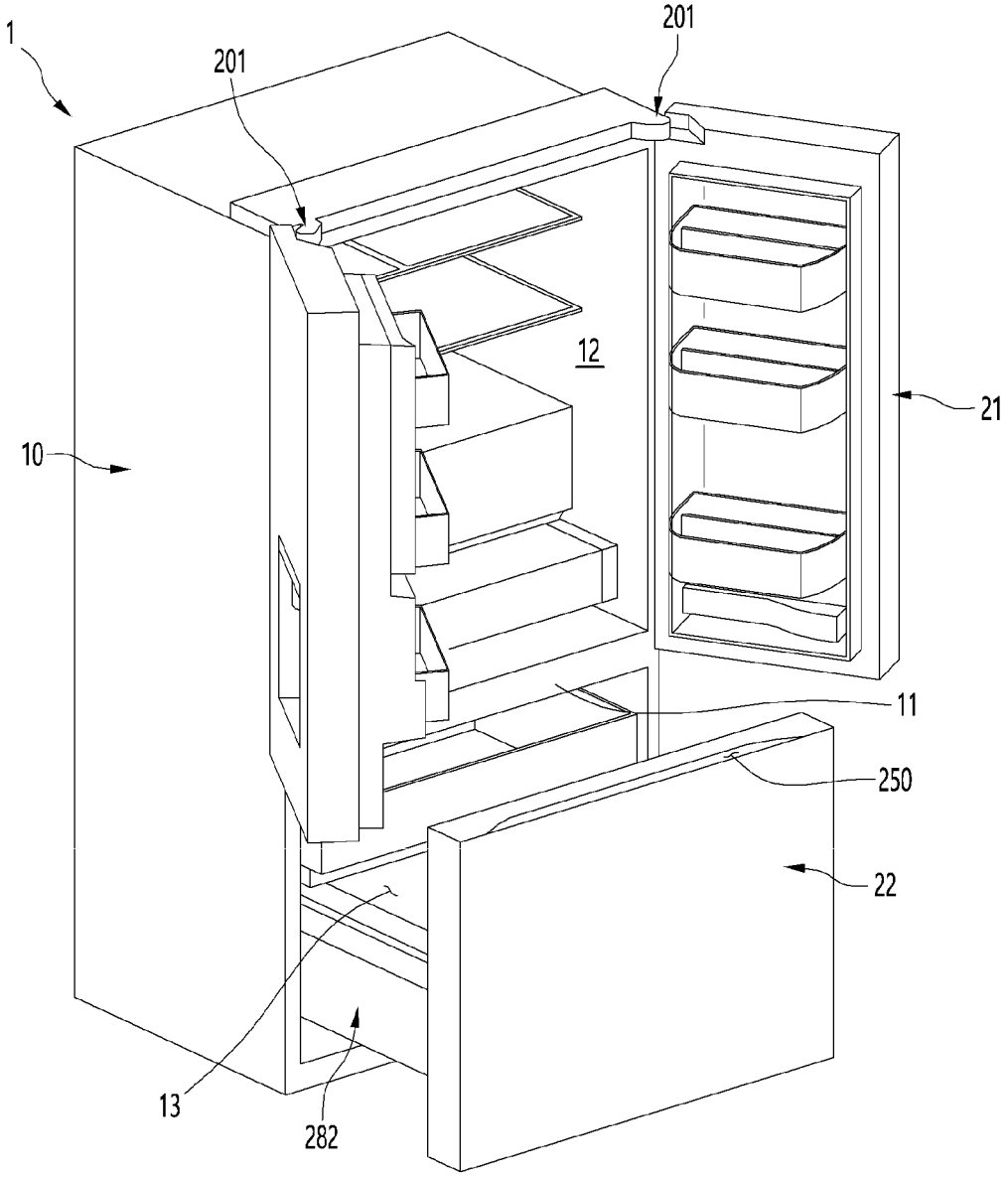
FIG. 2 is a perspective view illustrating a state where a door of the refrigerator is opened.
Figure 3:
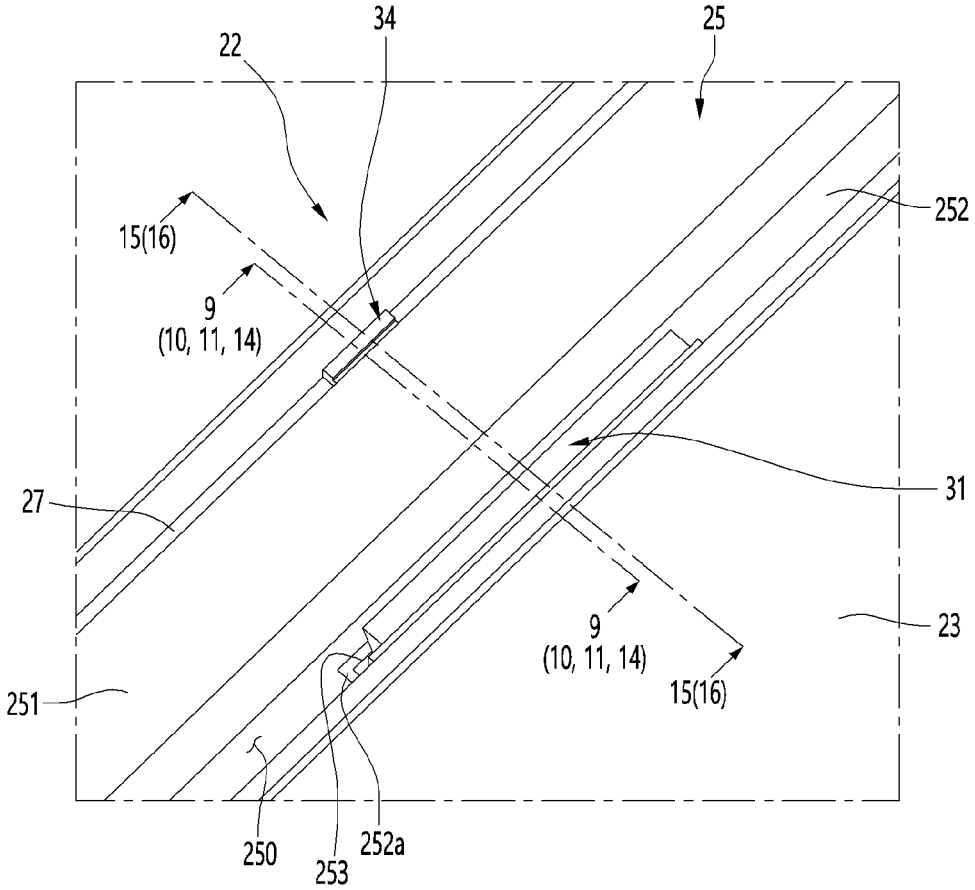
FIG. 3 is an enlarged view illustrating the upper portion of the door.

FIG. 1 is a perspective view illustrating a refrigerator according to a first embodiment of the present disclosure, FIG. 2 is a perspective view illustrating a state where a door of the refrigerator is opened and FIG. 3 is an enlarged view illustrating the upper portion of the door.

As illustrated, the refrigerator 1 according to the first embodiment of the present disclosure may include a cabinet 10 forming a storage space and a door 20 opening and closing the storage space.

The storage space of the cabinet 10 may be partitioned vertically by barriers 11, and a refrigerating chamber 12 may be formed at the upper portion and a freezing chamber 13 may be formed at the lower portion. In addition, the door 20 may include a refrigerating chamber door 21 opening and closing the refrigerating chamber 12 and a freezing chamber door 22 opening and closing the freezing chamber 13.

The refrigerating chamber door 21 may be mounted to the cabinet 10 by a hinge device 201 such that a pair of doors are rotatable on both left and right sides. In addition, the refrigerating chamber door 21 may open and close the refrigerating chamber 12 by rotation. Accordingly, the refrigerating chamber door 21 may be referred to as a rotary door. In addition, a handle may be provided on the lower surface of the refrigerating chamber door 21 so that the user can rotate the door 20 by inserting his/her hand.

The freezing chamber door 22 may be mounted to the cabinet 10 to be slidably drawn in and out. In addition, the freezing chamber 13 can be opened and closed by being drawn in and out of the freezing chamber door 22. In addition, the freezing chamber door 22 includes a basket 282 on the rear side of the door and may be configured in the form of a drawer. Accordingly, the freezing chamber door 22 may be referred to as a drawer type door 20. In addition, a handle 250 into which a hand of a user can be inserted and draw in and out the freezing chamber door 22 may be provided on an upper surface of the freezing chamber door 22.

In the embodiment of the present disclosure, a bottom freeze type refrigerator in which the freezing chamber 13 is provided below is described as an example, but the present disclosure can be applied to all types of doors in which the handle 250 is recessed. In addition, the door opening device 30 is disposed on the handle 250 to facilitate the opening operation of the freezing chamber door 22. In this embodiment, the case where the door opening device 30 is applied to the freezing chamber door 22 or the drawer type door will be described as an example. Of course, the door opening device 30 may be provided on the refrigerating chamber door 21 or the rotary door.

The handle 250 may be recessed on an upper surface of the freezing chamber door 22. In addition, an operating member 31 that can be operated by a user may be disposed on the recessed inner surface of the handle 250. The operating member 31 is disposed on the recessed inner surface of the handle 250 and may be disposed forward from the center of the handle 250. Accordingly, when the user grasps the handle 250 to open the freezing chamber door 22, the operating member 31 may be naturally operated. In addition, the operating member 31 is disposed inside the handle 250 and is not exposed to the outside when the refrigerator 1 is viewed from the front.

In addition, when the operating member 31 is operated, the push member 34 protrudes from the rear surface of the freezing chamber door 22 to push the cabinet 10 or the barrier 11 to open the freezing chamber door 22. In addition, the remaining portions of the door opening device 30 except for portions of the operating member 31 and the push member 34 are disposed inside the freezing chamber door 22 and are not exposed.

Hereinafter, a structure in which the door opening device 30 is provided in the freezing chamber door 22 will be described as an example.

Figure 4:
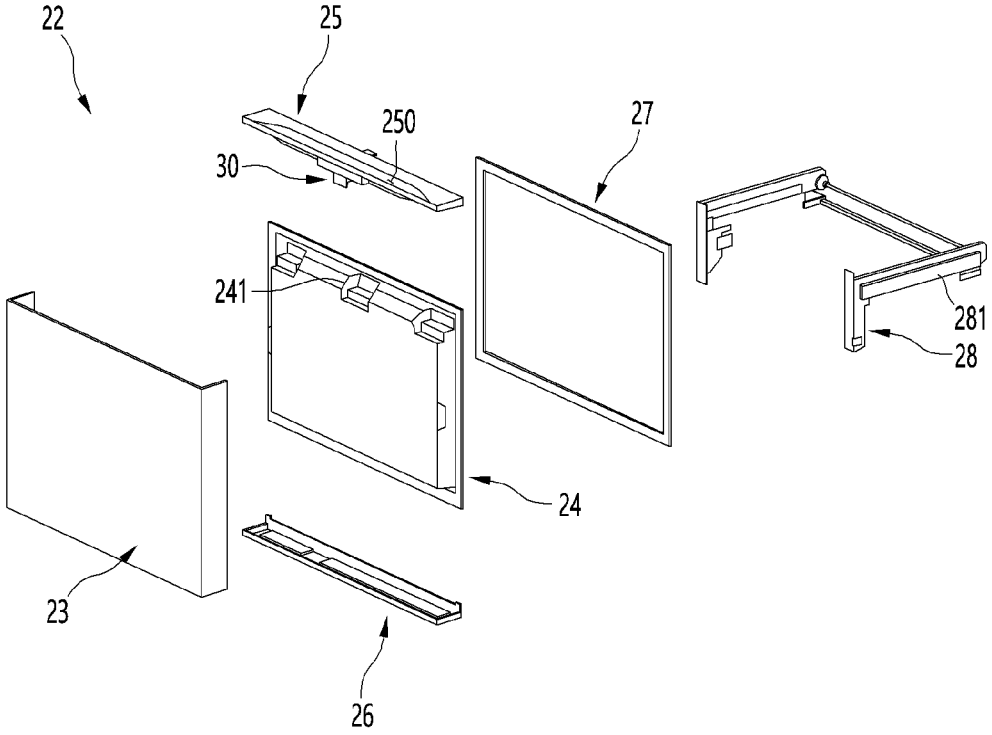
FIG. 4 is an exploded perspective view illustrating the door.
Figure 5:
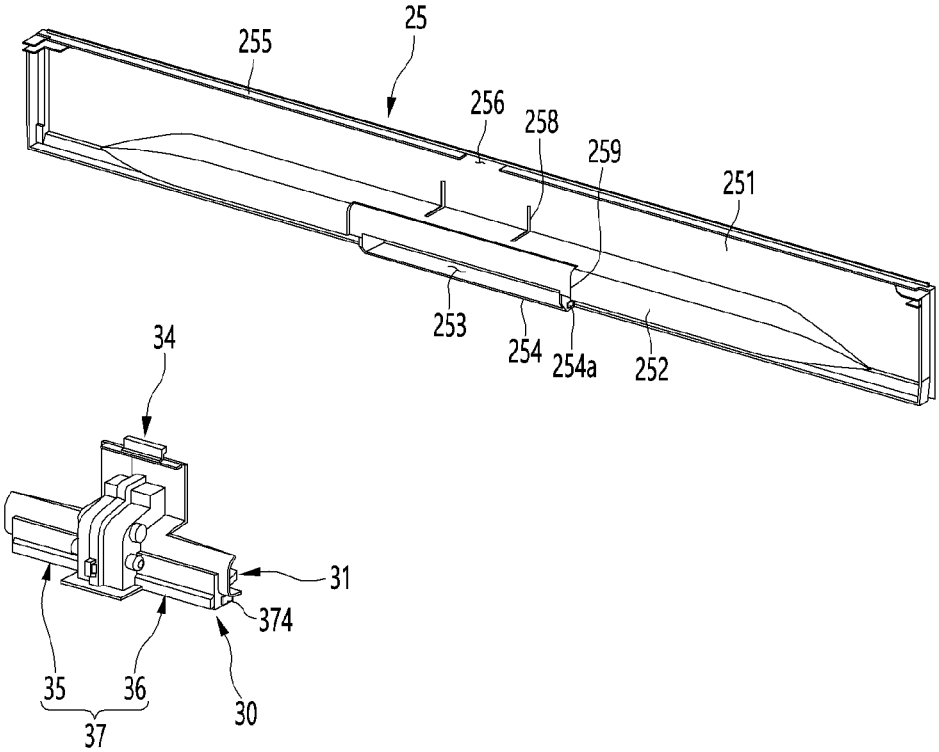
FIG. 5 is an exploded perspective view illustrating a coupling structure between the cap decoration of the door and the door opening device.
Figure 6:
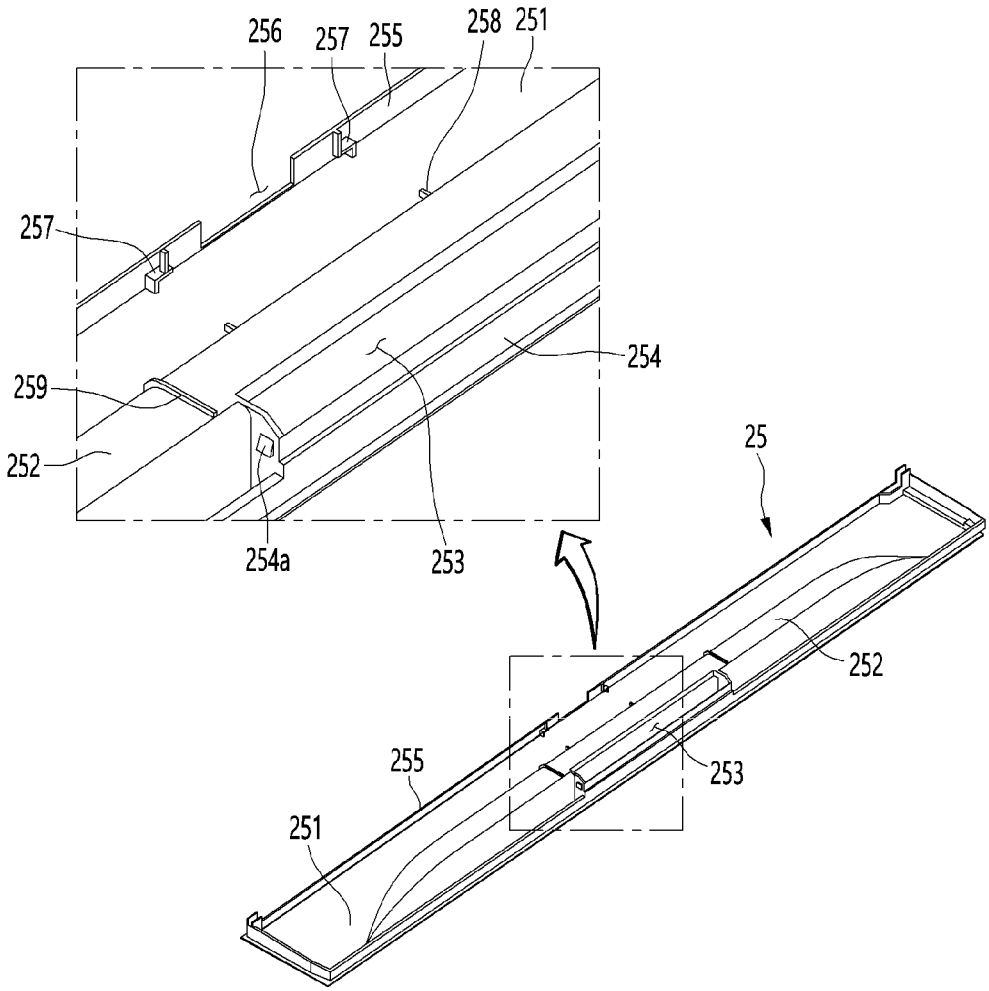
FIG. 6 is a perspective view illustrating the lower surface of the cap decoration.

FIG. 4 is an exploded perspective view illustrating the door, FIG. 5 is an exploded perspective view illustrating a coupling structure between the cap decoration of the door and the door opening device, and FIG. 6 is a perspective view illustrating the lower surface of the cap decoration.

As illustrated, the freezing chamber door 22 may include a door plate 23 forming a front surface, a door liner 24 forming a rear surface, and cap decorations 25 and 26 forming upper and lower surfaces. An insulator 29 may be filled inside the freezing chamber door 22 where the door plate 23, the door liner 24, and the cap decorations 25 and 26 are coupled.

The door plate 23 may form the front and both side surfaces of the freezing chamber door 22. For example, the door plate 23 may be formed of a metal material. In addition, the door liner 24 may be formed of a plastic material and may be molded to form the shape of the rear surface of the door 20. In addition, a liner recessed portion 241 may be formed in the door liner 24 to provide a disposition space for the door opening device 30. The liner recessed portion 241 is recessed at a position corresponding to that of the door opening device 30 to maintain a constant distance from the door opening device 30. Accordingly, the disposition thickness of the insulator 29 can be secured even at the position where the door opening device 30 is mounted.

A gasket 27 may be provided along the rear circumference of the door liner 24. The gasket 27 may contact the front surface of the cabinet 10 when the door is closed to make the freezing chamber 13 airtight.

In addition, door frames 28 may be formed on both left and right sides of the door liner 24. The door frame 28 may extend rearward, and the door basket 282 may be seated therein. In addition, a rail 281 is provided on the door frame 28 so that the freezing chamber door 22 can be slid in and out.

The cap decorations 25 and 26 may include an upper cap decoration 25 forming the upper surface of the freezing chamber door 22 and a lower cap decoration 26 forming the lower surface of the freezing chamber door 22. In addition, the handle 250 may be formed on the upper cap decoration 25. In addition, a door opening device 30 may be provided at the center of the upper cap decoration 25 in the left and right directions.

The upper cap decoration 25 includes a decoration upper surface 251 forming an upper surface, and a handle portion 252 forming the handle 250 may be recessed in the decoration top surface 251. In addition, the handle portion 252 may extend along the left and right longitudinal directions of the upper cap decoration 25.

The handle portion 252 may be recessed downward from the decoration upper surface 251 to form the inner surface of the handle 250. In addition, the handle portion 252 is disposed close to the front surface of the freezing chamber door 22 in the front and rear direction, so that the user can put his or her hand into the handle 250 and grasp the handle together with the front surface of the freezer door 22.

A handle opening 253 in which the operating member 31 is positioned may be formed in the handle portion 252. The handle opening 253 may be formed over the lower surface and the front surface of the handle portion 252. That is, the handle opening 253 is formed to pass through the upper cap decoration 25 and may be opened to communicate with the handle 250. In addition, at least a portion of the operating member 31 may pass through the handle 250 and extend into the recessed handle 250. Therefore, the operating member 31 can be moved by a user's operation inside the handle 250.

A guide protrusion **252*a* protruding along the circumference of the handle opening 253 may be formed inside the handle 250. The guide protrusion 252*a* may contact a lower protrusion 311*b* formed on the operating member 31**.

Guide ribs 258 and 259 guiding the case 37 of the door opening device 30 may protrude downward from the decoration upper surface 251 and the handle portion 252. The guide ribs 258 and 259 are formed to support the circumference of the case 37 so that the case 37 can be mounted in an accurate position on the upper cap decoration 25. The handle opening 253 may be formed in inner regions of the guide ribs 258 and 259.

A case mounting portion 254 to which the case 37 is mounted may be formed on the upper cap decoration 25. In addition, the handle opening 253 may be opened on a lower surface of the case mounting portion 254. In addition, when the case 37 is coupled to the case mounting portion 254, the operating member 31 may pass through the handle opening 253 and be positioned inside the handle 250.

Mounting protrusions 254*a* protruding inward may be formed on left and right side surfaces of the case mounting portion 254. Mounting grooves 374 inserted into the mounting protrusions 254*a* may be formed on both side surfaces of the case 37.

Meanwhile, a decoration edge 255 extending downward along the circumference of the decoration upper surface 251 may be included. In addition, an edge opening 256 through which the push member 34 passes may be formed at one side of a rear surface of the decoration edge 255.

In addition, insertion portions 257 may be formed on both left and right sides of the edge opening 256. The insertion portion 257 is formed so that the front end of the case 37 can be inserted. In a state where the front end of the case 37 is inserted into the insertion portion 257, the push member 34 may be aligned inside the edge opening 256.

To mount the case 37, in a state where the front end of the case 37 is first inserted into the insertion portion 257, the front end of the case 37 is rotated about an axis so that the mounting protrusion 254*a* and the mounting groove 374 can be coupled with each other. In this state, the door opening device 30 can be firmly fixed to the upper cap decoration 25.

Figure 7:
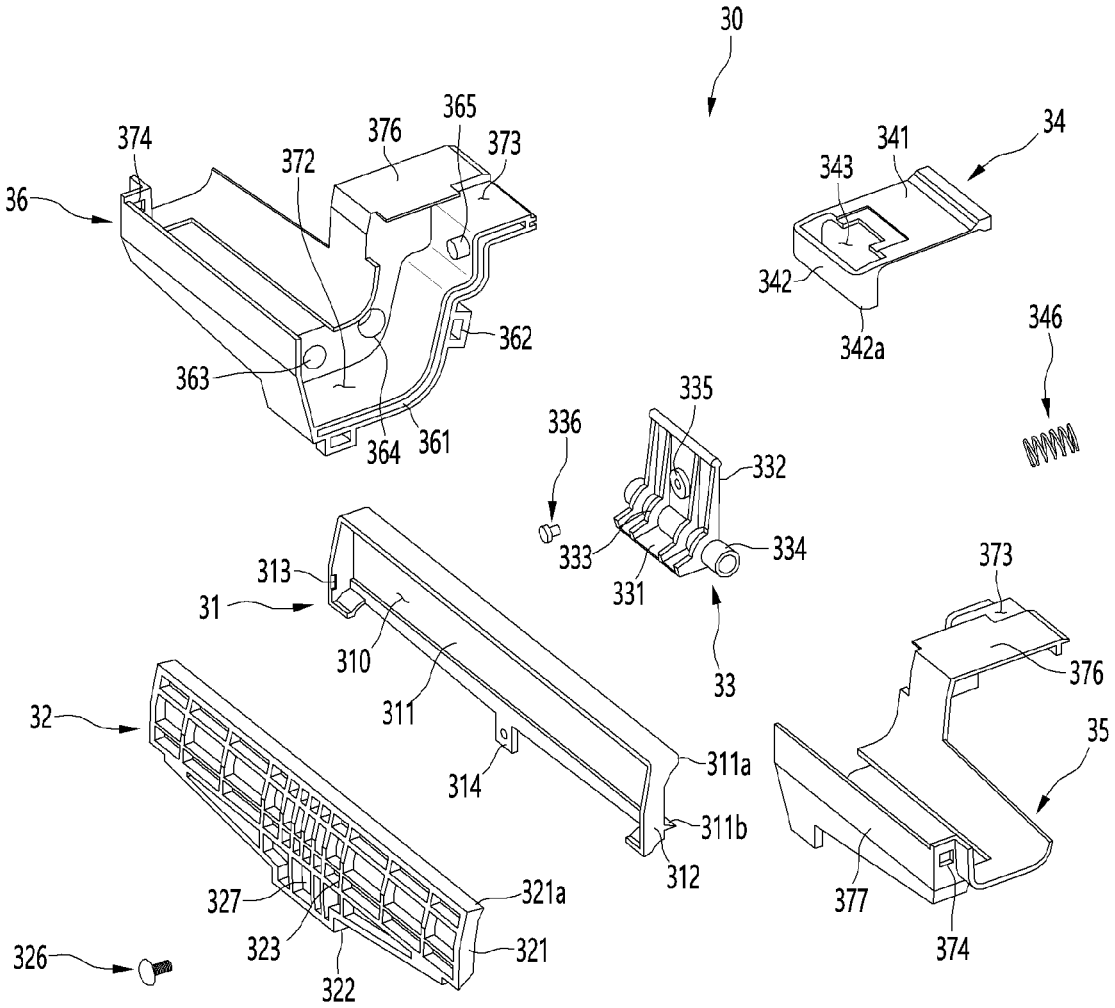
FIG. 7 is an exploded perspective view illustrating a state where the door opening device is disassembled viewed from the front.
Figure 8:
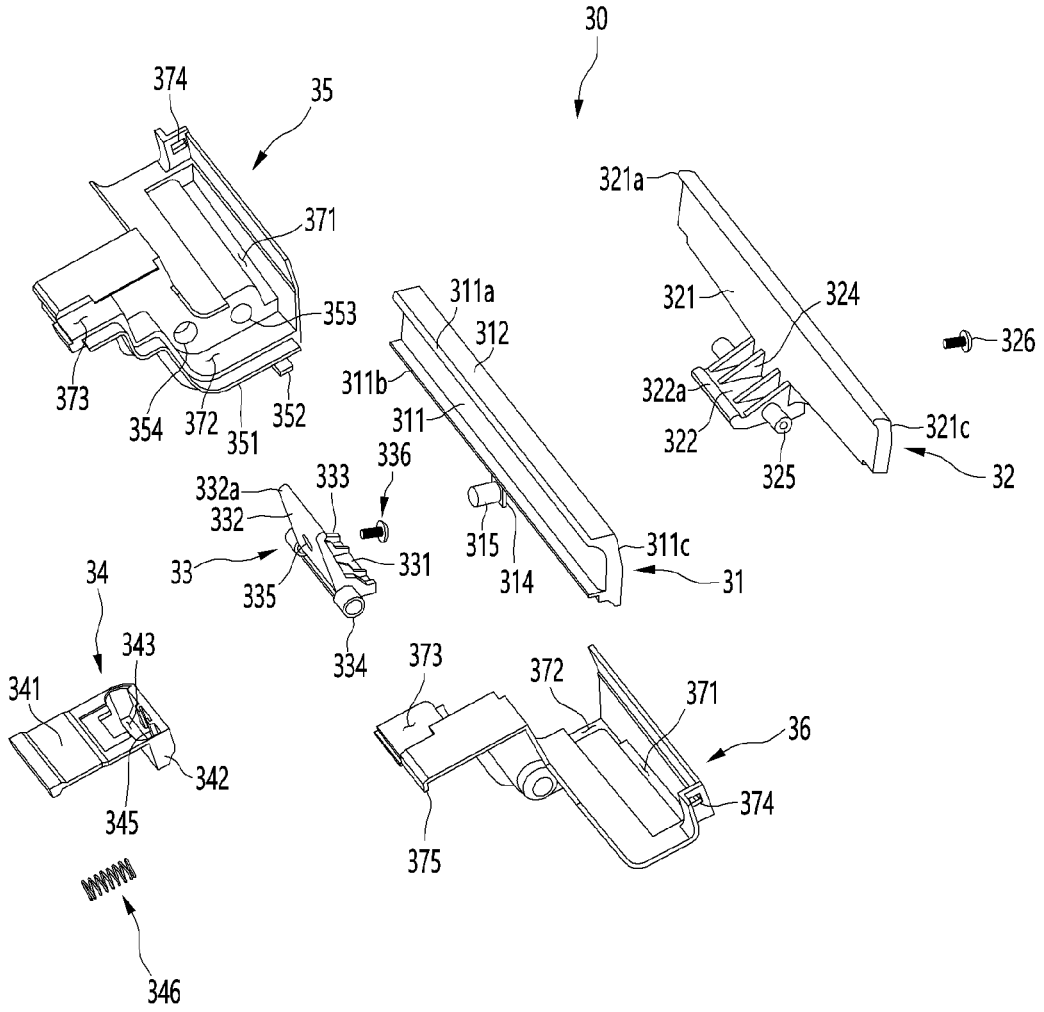
FIG. 8 is an exploded perspective view illustrating a state where the door opening device is disassembled viewed from the rear.
Figure 9:
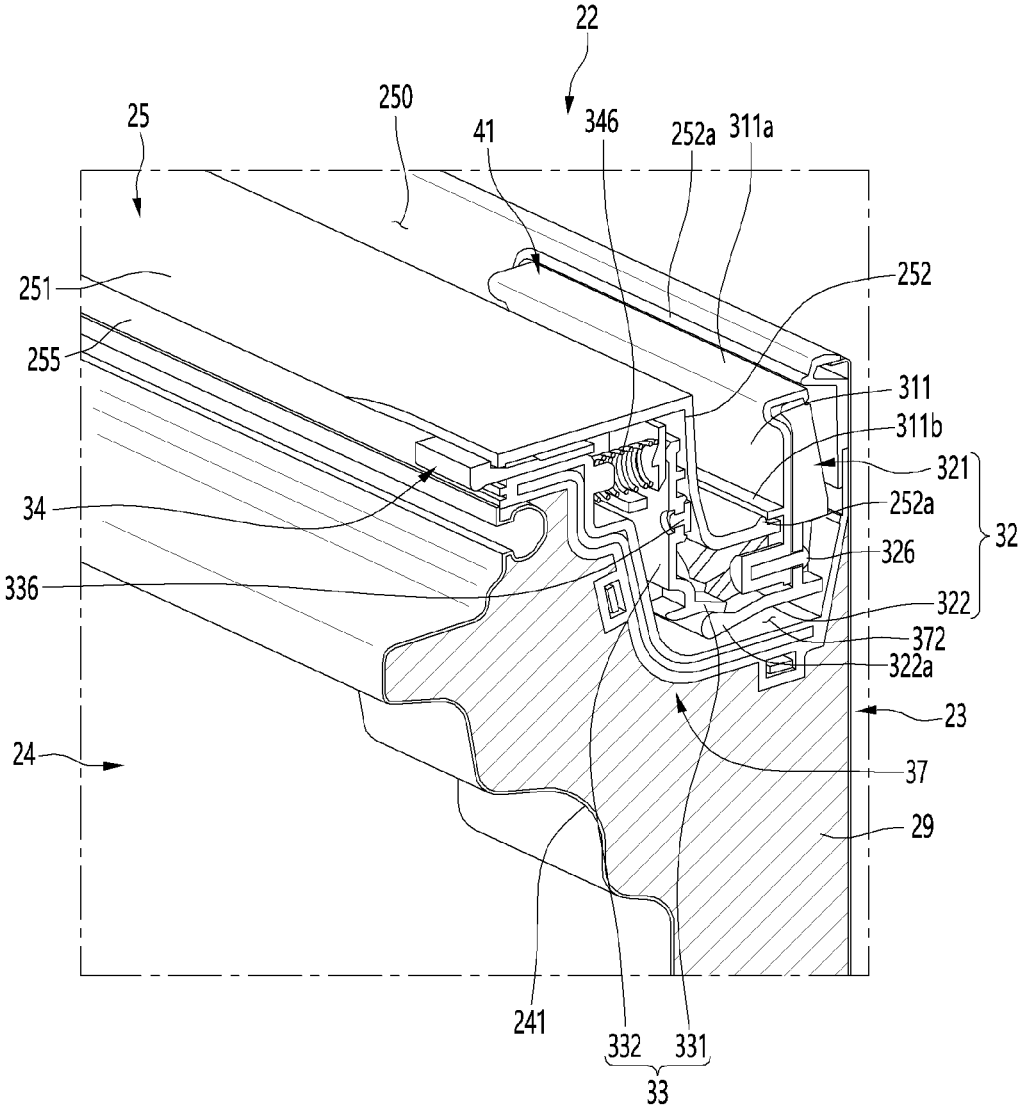
FIG. 9 is a cutaway perspective view taken along line 9-9 of FIG. 3.

FIG. 7 is an exploded perspective view illustrating a state where the door opening device is disassembled viewed from the front, FIG. 8 is an exploded perspective view illustrating a state where the door opening device is disassembled viewed from the rear, and FIG. 9 is a cutaway perspective view taken along line 9-9 of FIG. 3.

As illustrated, the door opening device 30 may include the operating member 31 and the case 37. In addition, the door opening device 30 may further include a link 33 and a push member 34.

The operating member 31 is a portion operated by a user and may be exposed to the inside of the handle 250. The operating member 31 may be formed of a plastic material that can have a sense of unity with the upper cap decoration 25. In addition, the operating member 31 can provide excellent texture and color.

The operating member 31 may include an operating portion 311 that extends in left and right directions and is shaped like a plate operated by a user. The operating portion 311 may have a size corresponding to that of the handle opening 253.

In addition, the rear surface of the operating portion 311 may be in contact with the user's hand. In addition, an upper protrusion 311*a* protruding rearward may be formed at an upper end of the operating portion 311. The upper protrusion 311*a* may extend to both left and right ends of the operating portion 311. The upper protrusion 311*a* protrudes so that the user's finger can be hooked thereon, so that the operation of the operating member 31 can be further facilitated.

A lower protrusion 311*b* protruding rearward may be provided at a lower portion of the operating portion 311. The lower protrusion 311*b* may extend to both left and right ends of the operating portion 311. In addition, the lower end of the operating portion 311 may extend downward more than the lower protrusion 311*b*. The lower protrusion 311*b* may shield a portion of the handle opening 253 from above. In addition, when the operating member 31 returns after being operated, the operating member may contact the guide protrusion 252*a* and maintain a stopped state at a set position.

In addition, an inclined portion 311*c* facing forward may be formed at an upper end of the front surface of the operating portion 311 as it extends downward. Even when the operating member 31 rotates, the upper end of the operating member 31 does not interfere with the case 37 or the upper cap decoration 25 due to the shape of the inclined portion 311*c*.

An operating member coupling portion 314 protruding downward may be included at the lower center of the operating portion 311. A boss 315 protruding rearward may be formed at the operating member coupling portion 314, and a screw 326 penetrating the supporter 32 to be described below may be fastened.

An operating portion edge 312 may protrude forward from the circumference of the operating portion 311. The operating portion edge 312 forms a circumferential surface of the operating member 31 and may form a supporter accommodation portion 310 in which the supporter 32 is mounted. In addition, a restraining protrusion 313 for restraining the supporter 32 may be further formed on the operating portion edge 312.

The supporter 32 may be provided in front of the operating member 31. The supporter 32 may be coupled to the front surface of the operating member 31. The supporter 32 may be accommodated inside the supporter accommodation portion 310 and may be coupled to the operating member 31 by a screw 326. The supporter 32 may be configured to withstand a load applied when the operating member 31 is operated.

Accordingly, the supporter 32 may be formed of a material having higher strength than the operating member 31. For example, the supporter 32 may be formed of an engineering plastic material. As another example, the supporter 32 may be formed of a metal material.

The supporter 32 may include a supporter body 321 coupled to the operating member 31 and a supporter extension 322 extending from the supporter body 321 to operate the link 33.

The supporter body 321 is formed in a shape corresponding to the supporter accommodation portion 310 and can be accommodated in the supporter accommodation portion 310. In addition, the supporter body 321 may be constrained within the supporter accommodation portion 310 by the restraining protrusion 313. In addition, a supporter protrusion 321*a* having a shape corresponding to the upper protrusion 311*a* may be formed at an upper end of the supporter body 321. Accordingly, the rear surface of the supporter body 321 including the supporter protrusion 321*a* may be completely in close contact with the operating portion 311. In addition, the supporter 32 can stably support the operating member 31 and reinforce strength when the operating member 31 is operated.

In addition, an inclined portion 321*c* facing forward may be formed at an upper end of the front surface of the supporter body 321 as it extends downward. Due to the shape of the inclined portion 321*c*, the upper end of the supporter 32 does not interfere with the case 37 or the upper cap decoration 25 when the operating member 31 rotates.

A supporter reinforcement portion 323 may be formed on the front surface of the supporter body 321. The supporter reinforcement portion 323 may be composed of a plurality of ribs and may be formed in a lattice shape. In addition, the rib spacing of the central portion of the supporter body 321 on which the supporter extension 322 is formed to be more dense than the rib spacing on both left and right ends, so that the strength of the supporter 32 and the supporter extension 322 can be further reinforced.

A screw hole 327 into which a screw 326 is fastened may be formed at a lower center of the supporter body 321. The screw 326 may pass through the screw hole 327 and be fastened to the boss 315. The operating member 31 and the supporter 32 may be integrally coupled by fastening the screw 326.

The supporter extension 322 may extend backward from the lower end of the supporter body 321. The supporter extension 322 may be extended to rotate in contact with the link 33. A supporter contact portion 322*a* contacting the link 33 may be formed at an extended end portion of the supporter extension portion 322. The supporter contact portion 322*a* may be formed to be round. In addition, a plurality of support ribs 324 connecting the supporter extension 322 and the supporter body 321 may be formed.

Supporter rotation shafts 325 may be formed on both left and right sides of the supporter extension 322. The supporter rotation shaft 325 may protrude to be axially coupled to the inner surface of the case 37. In this case, the supporter rotation shaft 325 may be positioned more rearward than the supporter body 321. The supporter rotation shaft 325 may be formed between the supporter body 321 and the rear end of the supporter extension 322. Therefore, the supporter rotation shaft 325 may be a rotational axis of the operating member 31 when the operating member 31 is operated, and the end portion of the supporter extension 322 rotates the link 33 by rotation thereof. The supporter rotation shaft 325 may be referred to as a first rotation shaft.

The link 33 may be provided behind the supporter 32. The link 33 allows the push member 34 to interlock when the operating member 31 is operated and can be rotatably mounted on the case 37. The link 33 may be referred to as a rotating member.

In detail, the link 33 may include a first part 331, a second part 332, and a link rotation shaft 334. The first part 331 may extend forward from the link rotation shaft 334. That is, the first part 331 may extend toward the operating member 31 and may extend to a position contacted when the supporter extension 322 rotates.

The second part 332 may extend upward from the link rotation shaft 334. That is, the second part 332 may extend toward the push member 34. The second part 332 may contact the rear end of the push member 34, and when the link 33 rotates, the second part 332 may push the rear end of the push member 34.

Force operated by the operating member 31 may be transmitted to the push member 34 through the link 33. Therefore, a plurality of link ribs 333 may be formed in the link 33 to reinforce the strength of the link 33. The link rib 333 may extend across the first part 331 and the second part 332. In addition, a plurality of link ribs 333 may be spaced apart from each other along the extension direction of the link rotation shaft 334.

A shock absorbing member 336 may be mounted on the second part 332. The shock absorbing member 336 may be formed of an elastic material such as rubber or silicon. The shock absorbing member 336 may protrude forward of the link 33, and may come into contact with one side of the upper cap decoration 25 according to the rotation of the link 33. For example, in a state where the operating member 31 is not operated, the shock absorbing member 336 may come into contact with the handle portion 252. When the link 33 returns after being rotated, the shock absorbing member 336 comes into contact with the handle 252 to relieve the impact and the link 33 does not rotate further. A shock absorbing member mounting portion 335 into which a separately molded shock absorbing member 336 is inserted and mounted may be formed in the second part 332.

The link rotation shaft 334 may protrude from both left and right sides of the link 33. The link rotation shaft 334 may be formed at a position adjacent to the rear end of the first part 331 and the lower end of the second part 332. The link rotation shaft 334 may be coupled to an inner surface of the case 37 and may cause the link 33 to rotate within the case 37. The link rotation shaft 334 may be referred to as a second rotation shaft.

The push member 34 may be mounted to slide in the case 37 in the front and rear direction. In addition, a portion of the push member 34 is provided inside the case 37, and the other portion thereof can protrude backward through the case 37 and the upper cap decoration 25. Further, the push member 34 may include a plate-shaped sliding portion 341 and a pressing portion 342 extending downward from the front end of the sliding portion 341.

The sliding portion 341 may be located inside the case 37 and the upper cap decoration 25. The front end of the sliding portion 341 may pass through the frame opening 256 and be exposed to the outside of the upper cap decoration 25. In this case, the front end of the sliding portion 341 may be thicker than the rest of the sliding portion 341. In addition, the front end of the sliding portion 341 may push the front surface of the cabinet 10 or the barrier 11 to open the freezing chamber door 22.

In addition, a slider opening 343 may be formed on an upper surface of the sliding portion 341. The inner shape of the pressing portion 342 can be easily injection molded by the slider opening 343.

The pressing portion 342 is formed at the front end of the sliding portion 341 and may extend to a position in contact with the link 33. An inclined surface 342*a* may be formed at a lower end of the pressing portion 342.

An elastic member mounting portion 345 protruding backward may be formed on a rear surface of the pressing portion 342. One end of the elastic member 346 may be fixedly mounted to the elastic member mounting portion 345. The other end of the elastic member 346 is supported on one surface of the case 37 so that an elastic force may be provided to the push member 34 in the draw-in direction.

The case 37 may form the outer appearance of the door opening device 30. The case 37 may form a space in which the insulator 29 inside the freezing chamber door 22 does not penetrate while being mounted on the freezing chamber door 22. In addition, the operating member 31, the link 33, and the push member 34 may be operably mounted in a space inside the case 37.

The upper surface of the case 37 may be coupled to the upper cap decoration 25, and the front and rear ends of the case 37 may be coupled to the door plate 31 and the door liner 24, respectively. The case 37 may be disposed in the center of the upper surface of the upper cap decoration 25, and may be disposed in an area at least partially overlapping with the handle 250.

For example, the case 37 may be composed of a first case 35 and a second case 36 forming both left and right sides. A case rib 351 and a case protrusion 352 may be formed in the first case 35. The case rib 351 may protrude along the end portion of the first case 35 facing the end portion of the second case 36. The case protrusion 352 may be formed in a hook shape and protrude from an end portion of the first case 35 toward the second case 36. A plurality of case protrusions 352 may be formed along the end portion of the first case 35.

A case groove 361 into which the case rib 351 is inserted may be formed in the second case 36. In addition, a case restraining portion 362 for engaging and restraining the case protrusion 352 may be formed in the second case 36. The first case 35 and the second case 36 are coupled to each other by the coupling of the case rib 351 and the case groove 361 and the coupling of the case protrusion 352 and the case restraining portion 362 and forms the shape of the case 37.

In addition, the first case 35 and the second case 36 may be formed in a shape symmetrical to each other as a whole. Further, spaces 371, 372, and 373 in which the operating member 31, the link 33, and the push member 34 are mounted may be formed by coupling the first case 35 and the second case 36.

In detail, an operating member accommodation space 371 in which the operating member 31 and the supporter 32 are mounted in a coupled state may be formed in the case 37. Lower portions of the operating member 31 and the supporter 32 may be inserted into the operating member accommodation space 371. In addition, the remaining portion of the operating member 31 may be exposed to the inside of the handle 250 through the handle opening 253.

In addition, a link accommodation space 372 in which the link 33 is accommodated may be formed in the case 37. A portion of the supporter 32 and a portion of the push member 34 may also be accommodated in the link accommodation space 372.

In the link accommodation space 372, first shaft coupling portions 353 and 363 to which the support rotation shaft 325 is rotatably coupled and second shaft coupling portions 354 and 364 to which the link rotation shaft 334 is rotatably coupled can be formed. The first shaft coupling portions 353 and 363 and the second shaft coupling portions 354 and 364 may be respectively formed on the first case 35 and the second case 36. Therefore, when the first case 35 and the second case 36 are coupled, the operating member 31 and the link 33 can be coupled in a rotatable state.

Meanwhile, the operating member accommodation space 371 and the link accommodation space 372 are opened upward and may be shielded by the upper cap decoration 25. In addition, the operating member accommodation space 371 may communicate with the handle opening 253, and a portion of the operating member 31 mounted in the operating member accommodation space 371 may be partially exposed through the handle opening 253.

A push member accommodation space 373 in which the push member 34 is accommodated may be formed in the case 37. The push member accommodation space 373 may open toward the upper and rear surfaces of the case 37. In addition, the push member 34 may be moved in the front and rear direction while being accommodated in the push member accommodation space 373. In addition, the push member accommodation space 373 may be stepped, the sliding portion 341 is disposed above the push member accommodation space 373, and the pressing portion 342 may be disposed at the stepped front end of push member accommodation space 373.

The push member accommodation space 373 may be opened upward and may be shielded by the upper cap decoration 25. In addition, the push member accommodation space 373 may open rearward and communicate with the edge opening 256. Accordingly, the rear end of the push member 34 may protrude backward through the push member accommodation space 373 and the edge opening 256.

An accommodation part protrusion 365 protruding forward may be formed at the front end of the push member accommodation space 373. The accommodation portion protrusion 365 is inserted into the front surface of the elastic member 346 and can restrain the front end of the elastic member 346.

The operating member accommodation space 371, the link accommodation space 372, and the push member accommodation space 373 may communicate with each other.

Hereinafter, the operation of the door opening device 30 having the above structure will be described in more detail with reference to drawings.

Figure 10:
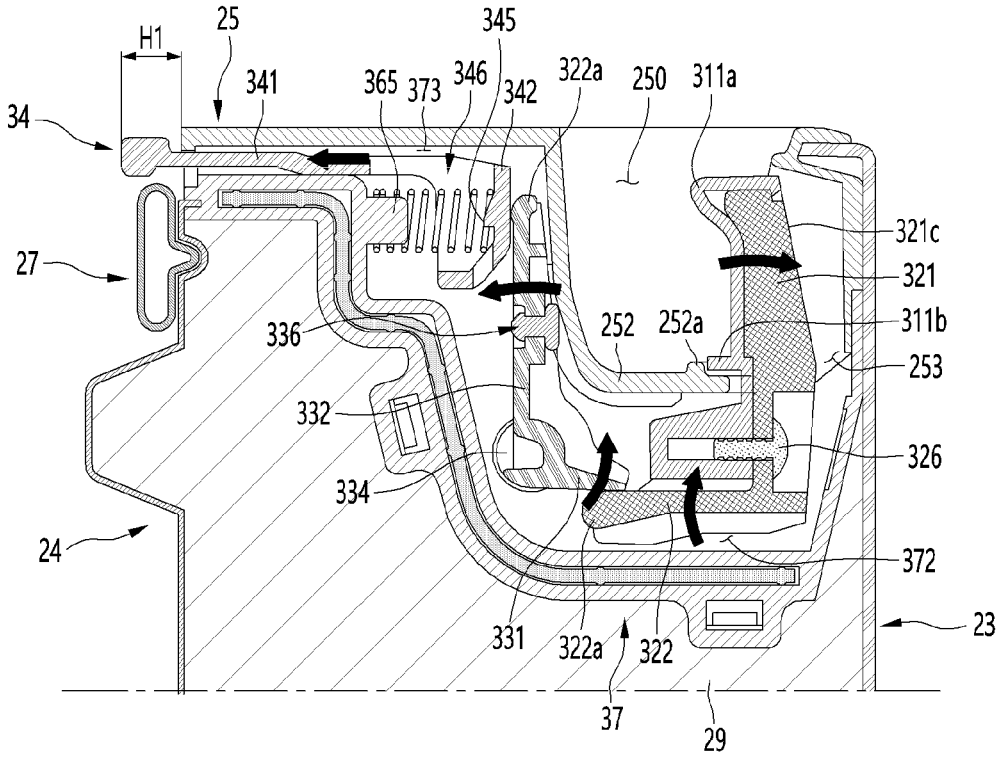
FIG. 10 is a cross-sectional view illustrating a state before operation of the door opening device.
Figure 11:
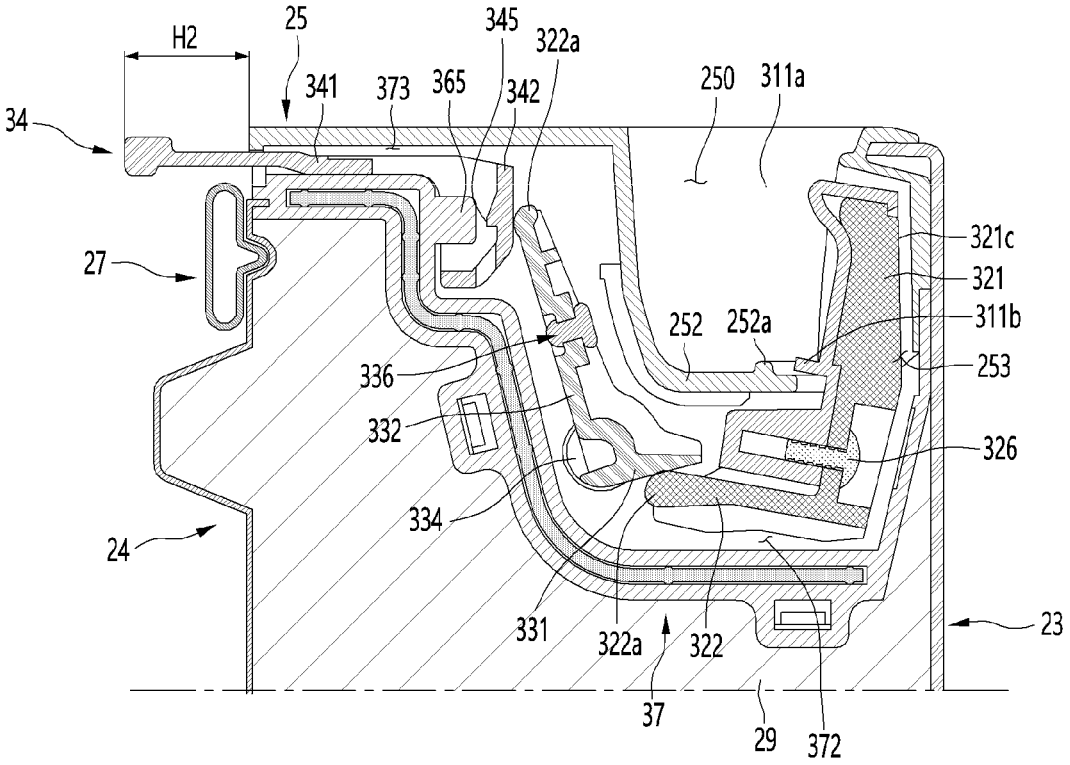
FIG. 11 is a cross-sectional view illustrating an operating state of the door opening device.

FIG. 10 is a cross-sectional view illustrating a state before operation of the door opening device, and FIG. 11 is a cross-sectional view illustrating an operating state of the door opening device.

As illustrated, the door opening device 30 maintains the state illustrated in FIG. 10 when the freezing chamber door 22 is closed.

In detail, before operating the door opening device 30, a portion of the operating member 31 is positioned within the handle 250. In addition, the lower protrusion 311*b* of the operating member 31 maintains a state in contact with the guide protrusion 252*a* of the handle portion 252, and the upper end of the operating member 31 may be in a state of most protruding toward the inside of the handle 250.

At this time, when the user puts his/her hand into the handle 250, the operating member 31 can naturally come into contact with the user's hand. In addition, the upper end of the operating member 31 may maintain the most spaced state from the front surface of the upper cap decoration 25, that is, the front surface of the freezing chamber door 22. In addition, the operating member 31 may maintain a state parallel to the front surface of the freezing chamber door 22 or a state perpendicular to the upper surface of the freezing chamber door 22.

The supporter 32 maintains a state of being in contact with the link 33. At this time, the supporter extension 322 may be in a state of being in simple contact with the first part 331, that is, a state of not pressing for rotation of the link 33. For example, the front end of the supporter extension 322 may come into contact with the lower surface of the first part 331. In addition, the shock absorbing member 336 may come into contact with the handle portion 252.

In addition, the upper end of the link 33 maintains a contact state with the push member 34. For example, an upper end of the rear surface of the second part 332 may come into contact with the front surface of the pressing portion 342. In addition, the first part 331 may maintain a state parallel to the front surface of the door 20 and/or a state perpendicular to the upper surface of the freezing chamber door 22. In addition, the first part 331 may be parallel to the operating member 31.

Meanwhile, the push member 34 may be moved most forward by the elastic force provided by the elastic member 346. In addition, the pressing portion 342 and the second part 332 may maintain a contact state, and the first part 331 and the supporter extension 322 may maintain a contact state.

Further, the protruding length H1 of the push member 34 from the rear surface of the upper cap decoration 25 to the rear end of the push member 34 may correspond to the thickness of the gasket 27. Accordingly, the rear end of the push member 34 may come into contact with the front surface of the cabinet 10 or the front surface of the barrier 11 before the operating member 31 is operated.

In this state, as soon as the operating member 31 is operated, the push member 34 moves backward and pushes the front surface of the cabinet 10 or the barrier 11 to assist in opening the freezing chamber door 22.

In a state where the freezing chamber door 22 is closed, the user may open the freezing chamber door 22 by holding and pulling the handle 250. In this case, the operating member 31 may be disposed at an eccentric position toward the front surface of the freezing chamber door 22 based on the center of the handle 250. In addition, the operating member 31 may be disposed on the front surface of the inner surface of the handle 250.

Therefore, when the user puts his/her hand into the handle 250 and pulls the handle, the user can naturally operate the operating member 31 inside. That is, the operation of the door opening device 30 and the operation of drawing the freezing chamber door 22 out can be performed at one time only by holding and pulling the handle 250 without additional operation.

In detail, when a user puts his/her hand into the handle 250 to open the freezing chamber door 22 and grasps the front upper end of the freezing chamber door 22, the user's hand naturally comes into contact with the operating member 31. In addition, the operating member 31 is located on the front surface of the inner surface of the handle 250, and the operating member 31 can be pressed while pulling the freezing chamber door 22.

As illustrated in FIG. 11, when the operating member 31 is pressed, the operating member 31 is rotated clockwise with respect to the supporter rotation shaft 325. At this time, the front surface of the operating member 31 moves toward the front surface of the freezing chamber door 22. The operating member 31 can be sufficiently rotated by the inclined surface 321*c* of the supporter 32, and the operating member 31 comes close to the front surface of the freezing chamber door 22.

In a state where the operating member 31 is fully rotated in a clockwise direction, the rear surface of the operating member 31 may be accommodated inside the handle opening 253. In addition, the lower protrusion 311*b* may be spaced apart from the guide protrusion 252*a*. When the operating member 31 is operated, the operating member 31 may cross the front surface of the door 20.

Meanwhile, when the operating member 31 rotates clockwise, the front end of the supporter extension 322 pushes the first part 331 upward, and the link 33 is rotated counterclockwise with respect to the link rotation shaft 334.

By the rotation of the link 33, the upper end of the second part 332 presses the pressing portion 342 of the push member 34 from the front to the rear. The rotation of the link 33 causes the push member 34 to move backward, and in this process, the elastic member 346 may be compressed. In addition, the rear end of the push member 34 pushes the front surface of the cabinet 10 or the front surface of the barrier 11.

At this time, the protruding length H2 of the push member 34 from the rear surface of the upper cap decoration 25 to the rear end of the push member 34 is greater than the protruding length H1 of FIG. 10. For example, the protrusion length H2 is longer than the thickness of the gasket 27. Accordingly, the rear end of the push member 34 pushes the front surface of the cabinet 10 or the front surface of the barrier 11 so that the freezing chamber door 22 can be opened more easily.

In addition, when the user releases his/her hand from the operating member 31 in a state where the opening operation of the freezing chamber door 22 is completed, the push member 34 is moved forward by the elastic restoring force of the elastic member 346, in this process, the link 33 rotates clockwise, and the operating member 31 moves counterclockwise to automatically return to the state before operation of the operating member 31 as illustrated in FIG. 10.

Meanwhile, various other embodiments of the present disclosure may be possible in addition to the above-described embodiments. a second embodiment of the present disclosure is characterized in that the door opening device includes a first link and a second link, and the second link is integrally coupled to the operating member. In the second embodiment of the present disclosure, other components except for the structure of the operating member and the second link are the same as those of the previous embodiment, and the detailed description and illustration of the same components are omitted and the same symbols are used to denote the same components.

Hereinafter, a second embodiment of the present disclosure will be described with reference to the drawings.

Figure 12:
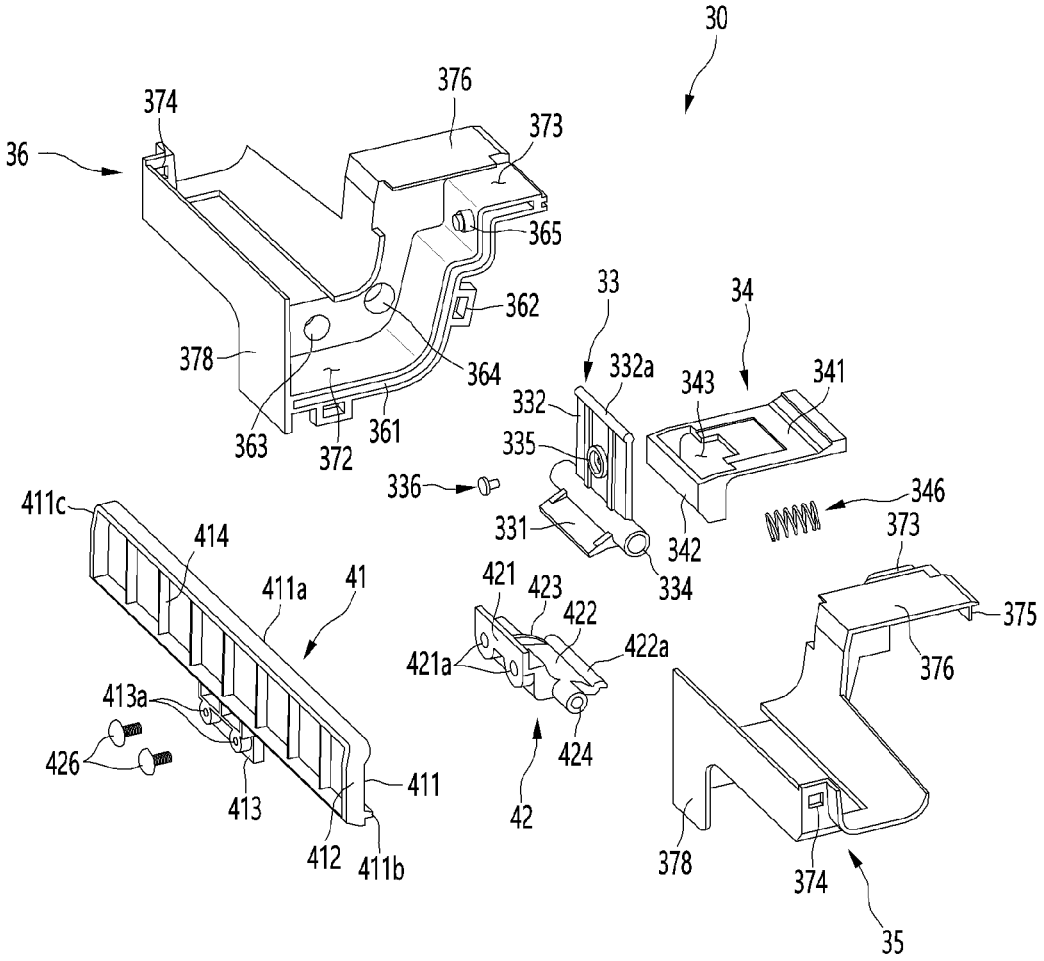
FIG. 12 is an exploded perspective view illustrating a state where the door opening device according to a second embodiment of the present disclosure is disassembled viewed from the front.
Figure 13:
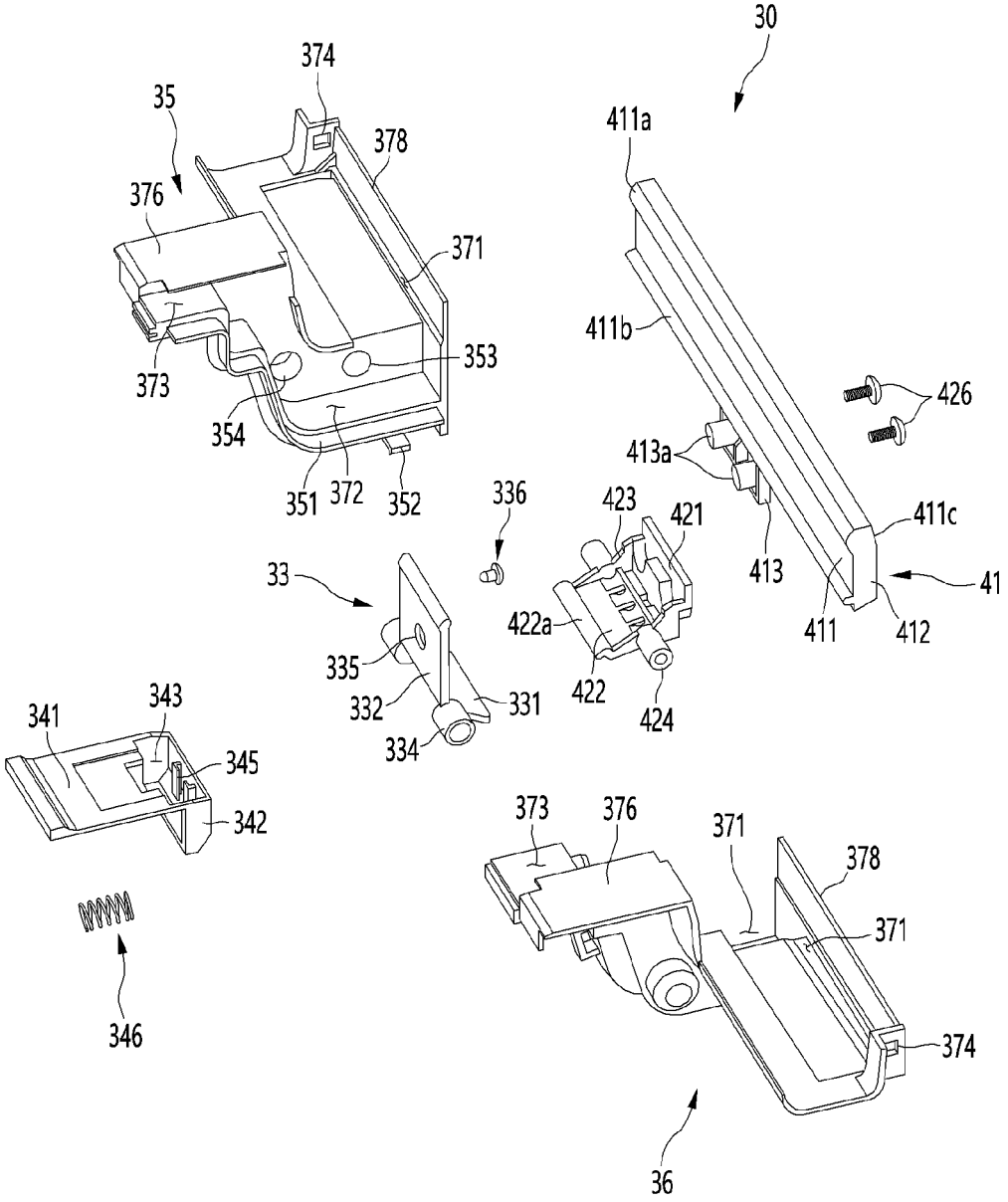
FIG. 13 is an exploded perspective view illustrating a state where the door opening device is disassembled viewed from the rear.
Figure 14:
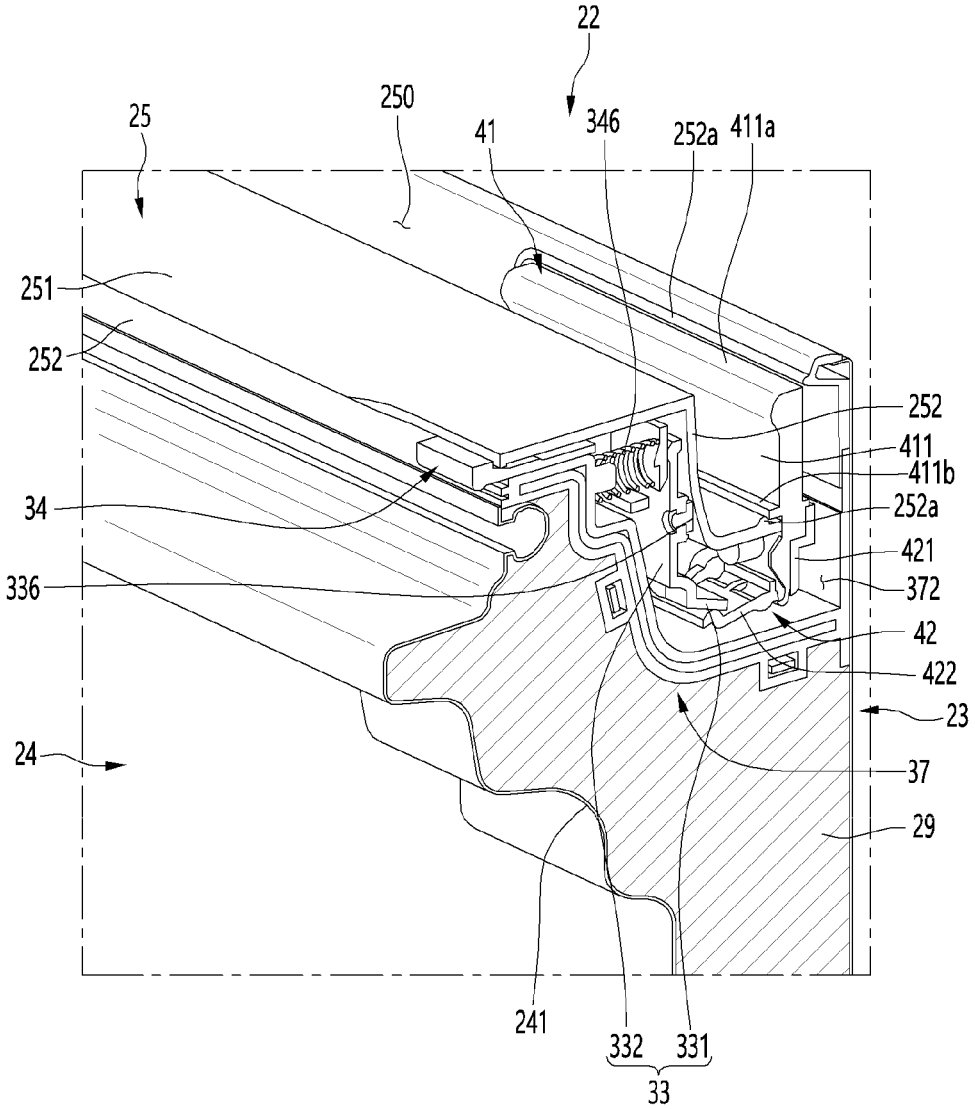
FIG. 14 is a cutaway perspective view taken along line 14-14 of FIG. 3.

FIG. 12 is an exploded perspective view illustrating a state where the door opening device according to a second embodiment of the present disclosure is disassembled viewed from the front, FIG. 13 is an exploded perspective view illustrating a state where the door opening device is disassembled viewed from the rear, and FIG. 14 is a cutaway perspective view taken along line 14-14 of FIG. 3.

As illustrated, the door opening device 30 according to the second embodiment of the present disclosure may include an operating member 41, a first link 33, a second link 42, a push member 34, and a case 37 may be included. In addition, structures of the case 37, the first link 33, and the push member 34 may be the same as those of the above-described embodiment.

The operating member 41 may be exposed to the inside of the handle 250 through the handle opening 253 so that the user can press and operate the handle 250 by hand. The operating member 41 may include an operating portion 411 providing a surface pressed by the user. An upper protrusion 411*a* may be formed at an upper end of the rear surface of the operating portion 411, and a lower protrusion 411*b* may be formed at a lower end of the rear surface of the operating portion 411.

In addition, an inclined portion 411*c* facing forward may be formed at an upper end of the front surface of the operating portion 411 as it extends downward. Due to the shape of the inclined portion 411*c*, the upper end of the operating member 41 does not interfere with the case 37 or the upper cap decoration 25 when the operating member 41 rotates.

An operating portion edge 412 extending forward along the circumference of the operating portion 411 may be formed. In addition, a plurality of reinforcing ribs 414 may be formed on the front surface of the operating portion 411.

An operating member coupling portion 413 extending downward may be formed at the lower center of the operating portion 411. The operating member coupling portion 413 may be coupled to the second link 42. For example, a boss 413*a* to which a screw 426 is fastened may be formed in the operating member coupling portion 413.

The second link 42 may be formed of a material having higher strength than the operating member 41. The operating member 41 exposed through the handle opening 253 and in contact with the user's hand may be injection-molded with a plastic material having excellent outer appearance quality. On the other hand, the second link 42 is formed of a material having excellent strength and can withstand a load applied when the operating member 41 is operated.

The second link 42 may be integrally coupled with the operating member 41 and operated together with the operating member 41. The second link 42 may include a third part 421 and a fourth part 422 and a second link rotation shaft 424.

The third part 421 is a portion coupled to the operating member coupling portion 413 and may extend upward. A screw hole 421*a* through which the screw 426 passes may be formed in the third part 421. The screw 426 may pass through the screw hole 421*a* of the third part 421 and be fastened to the boss 413*a*. Therefore, when the operating member 41 is operated, the operating member 41 is rotated about the second link rotation shaft 424.

The fourth part 422 may extend rearward from a lower end of the third part 421. The fourth part 422 may extend to a position in contact with the first link 33. The front end of the fourth part 422 may have a rounded fourth part contact portion 422*a* and may come into contact with the lower surface of the first part 331 of the first link 33.

A plurality of link ribs 423 may be further formed between the third part 421 and the fourth part 422. Strength of the third part 421 and the fourth part 422 may be reinforced by the link rib 423.

In addition, the second link rotation shaft 424 may be located at the lower end of the third part 421 and the front end of the fourth part 422. The second link rotation shaft 424 may be a rotation shaft of the second link 42 and the operating member 41 and may be coupled to the first shaft coupling portions 353 and 363 of the case 37.

The first link 33 may be disposed in a state in contact with the second link 42 and may be rotated by the second link 42. The first link 33 may include a first part 331, a second part 332, and a link rotation shaft 334. In addition, a shock absorbing member mounting portion 335 to which the shock absorbing member 336 is mounted may be formed in the second part 332. In addition, a link contact portion 332*a* may be further formed at an upper end of the second part 332. The link contact portion 332*a* may be in contact with the push member 34 to slide the push member 34.

The push member 34 may include a sliding portion 341 that moves in the front and rear direction, and a pressing portion 342 that is bent downward at the front end of the sliding portion 341 and contacts the first link 33. A slider opening 343 may be formed in the sliding portion 341, and an elastic member mounting portion 345 to which the elastic member 346 is mounted may be formed at a rear surface of the pressing portion 342.

In addition, the case 37 may be composed of a first case 35 and a second case 36. An operating member accommodation space 371 in which the operating member 41 is accommodated by the coupling of the first case 35 and the second case 36, a link accommodation space 372 in which the first link 33 and the second link 42 are disposed, and a push member accommodation space 373 in which the push member 34 is accommodated may be formed.

In addition, the first case 35 and the second case 36 may have first shaft coupling portions 353 and 363 to which the second link rotation shaft 424 is coupled, and a second shaft coupling portions 354 and 364 to which the link rotation shaft 334 is coupled. In addition, a case rib 351, a case groove 361, a case protrusion 352, and a case restraining portion 362 are formed in the first case 35 and the second case 36, respectively, so that the first case 35 and the second case 36 may be coupled to each other.

Hereinafter, the operation of the door opening device 30 having the above structure will be described in more detail with reference to drawings.

Figure 15:
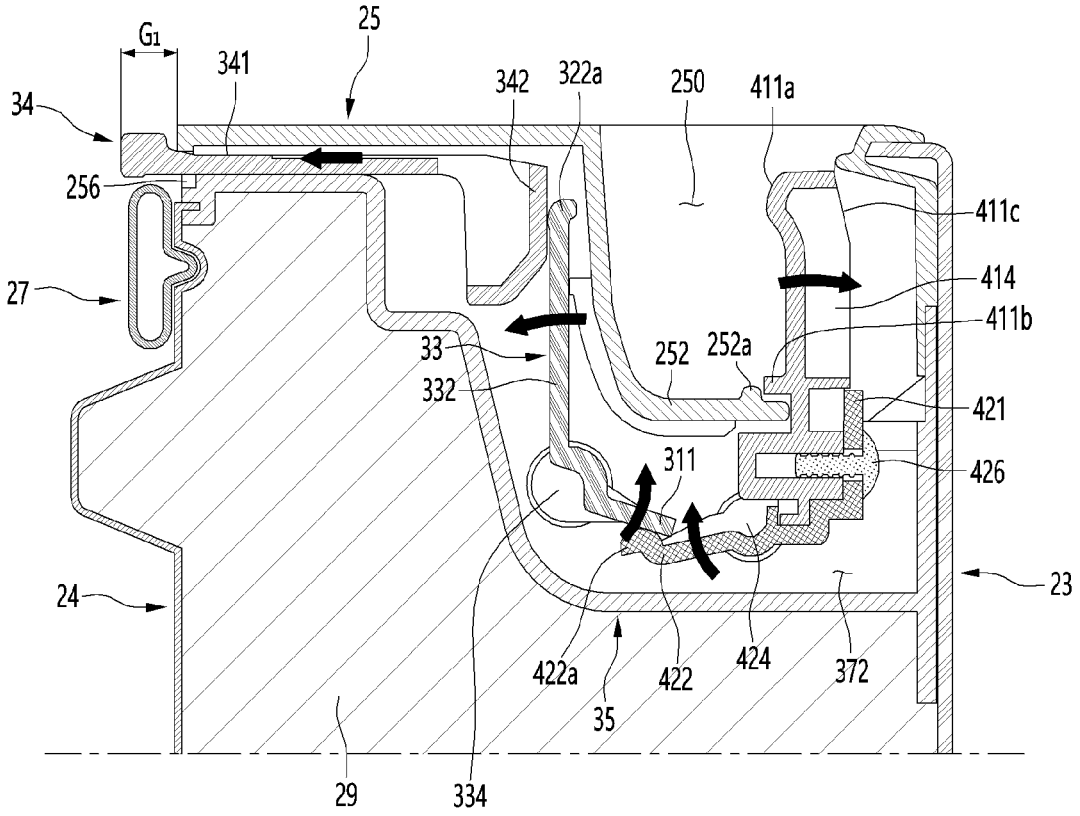
FIG. 15 is a cross-sectional view illustrating a state before operation of the door opening device.
Figure 16:
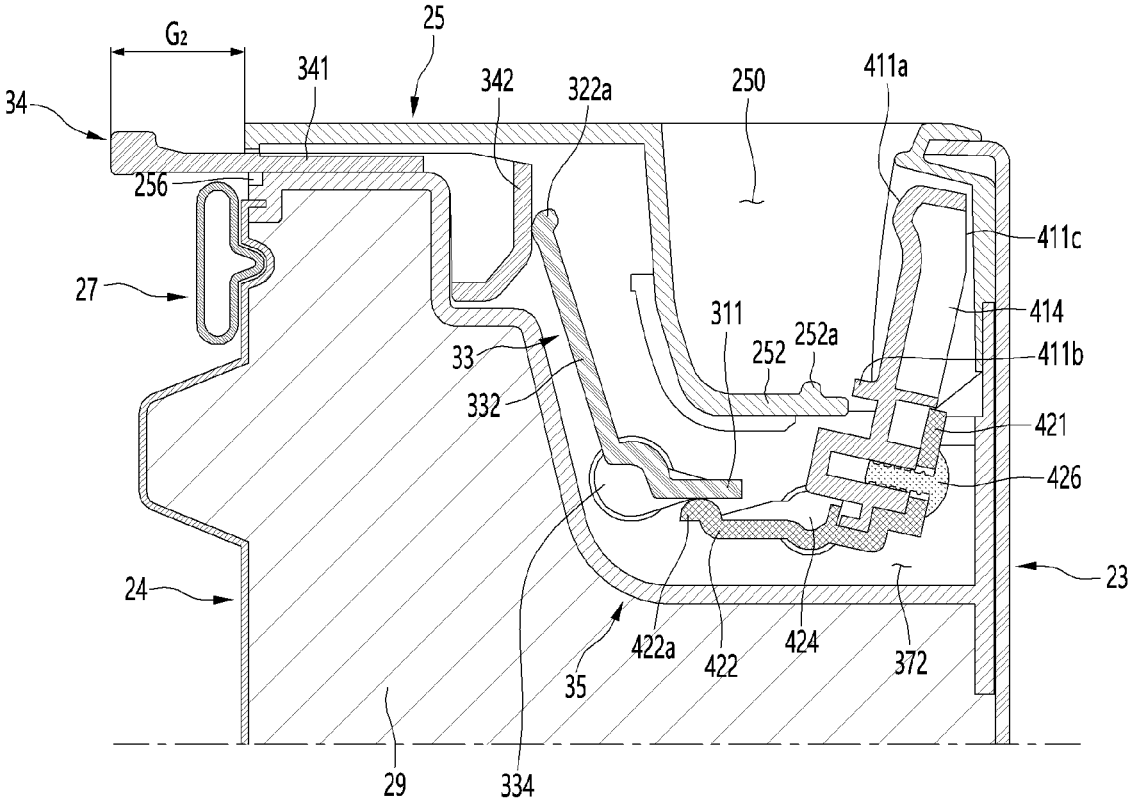
FIG. 16 is a cross-sectional view illustrating an operating state of the door opening device.

FIG. 15 is a cross-sectional view illustrating a state before operation of the door opening device, and FIG. 16 is a cross-sectional view illustrating an operating state of the door opening device.

A state where the door opening device 30 is not operated is a state as illustrated in FIG. 15. In a state before the door opening device 30 is operated, the operating member 41 protrudes into the handle 250.

At least a portion of the operating member 41 protrudes to the inside of the handle 250 and may be spaced apart from the front surface of the upper cap decoration 25 or the front surface of the freezing chamber door 22. Therefore, the operating member 41 maintains a rotationally operable state.

In a state prior to the operation of the operating member 41, the operating member 41 may be disposed parallel to the front surface of the freezing chamber door 22. In addition, the inner surface of the handle 250 may become narrower downward. Accordingly, an upper portion of the operating member 41 may protrude into the recessed space of the handle 250.

In addition, the second link 42 coupled to the operating member 41 may be in contact with the first link 33. That is, the fourth part 422 may be in a state of supporting the lower surface of the first part 331.

In addition, the first link 33 may come into contact with the push member 34. That is, the upper end of the second part 332 may come into contact with the pressing portion 342. In addition, the push member 34 may be moved most forward by the elastic force of the elastic member 346.

In addition, the protruding distance G1 from the rear surface of the upper cap decoration 25 to the rear end of the push member 34 can be minimized. In this case, the protruding distance G1 may be equal to or smaller than the thickness of the gasket 27.

A user puts his/her hand into the handle 250 and pulls it to open the freezing chamber door 22. At this time, the user's hand presses the operating member 41. That is, the process of pulling the freezing chamber door 22 forward and the process of pressing the operating member 41 forward can be simultaneously performed as one operation.

When the operating member 41 is pressed, the operating member 41, the first link 33, the second link 42, and the push member 34 may be in a state as illustrated in FIG. 16.

In detail, when the operating member 41 is pressed, the operating member 41 rotates clockwise around the second link rotation shaft 424 as an axis. In addition, the fourth part 422 of the second link 42 presses the first part 331 of the first link 33 from bottom to top.

Accordingly, the first link 33 rotates counterclockwise, and the second part 332 of the first link 33 pushes the push member 34 backward. The push member 34 moves backward, and at this time, the elastic member 346 may be compressed.

In addition, the rear end of the push member 34 may further protrude rearward. A protruding distance G2 from the rear surface of the upper cap decoration 25 to the rear end of the push member 34 increases and becomes longer than the thickness of the gasket 27. Accordingly, the rear end of the push member 34 may push the front surface of the cabinet 10 or the front surface of the barrier 11 to open the freezing chamber door 22.

Meanwhile, when the opening of the freezing chamber door 22 is completed, the user releases his/her hand from the handle 250 and the force applied to the operating member 41 may be removed. At the same time, the push member 34 is moved forward by the elastic restoring force of the elastic member 346. As the push member 34 moves, the first link 33 rotates clockwise. In addition, the second link 42 is rotated counterclockwise by the first link 33, and the operating member 41 is also rotated together. Finally, the door opening device 30 returns to the state illustrated in FIG. 15.

Meanwhile, various other embodiments of the present disclosure may be possible in addition to the above-described embodiments. A third embodiment of the present disclosure is characterized in that a supporter having a different structure is provided to the operating member of the door opening device. In the third embodiment of the present disclosure, other components except for the operating member and the supporter are the same as those of the previous embodiment, and the detailed description and illustration of the same components are omitted and the same reference numerals are used to denote the same components.

Hereinafter, a third embodiment of the present disclosure will be described with reference to the drawings. A door opening device according to a third embodiment of the present disclosure may include the operating member and the case. I addition, the door opening device may further include any one of a link, a push member, and an elastic member. Since these configurations are the same as those of the foregoing embodiment except for some structures of the operating member, detailed descriptions except for the operating member will be omitted.

Figure 17:
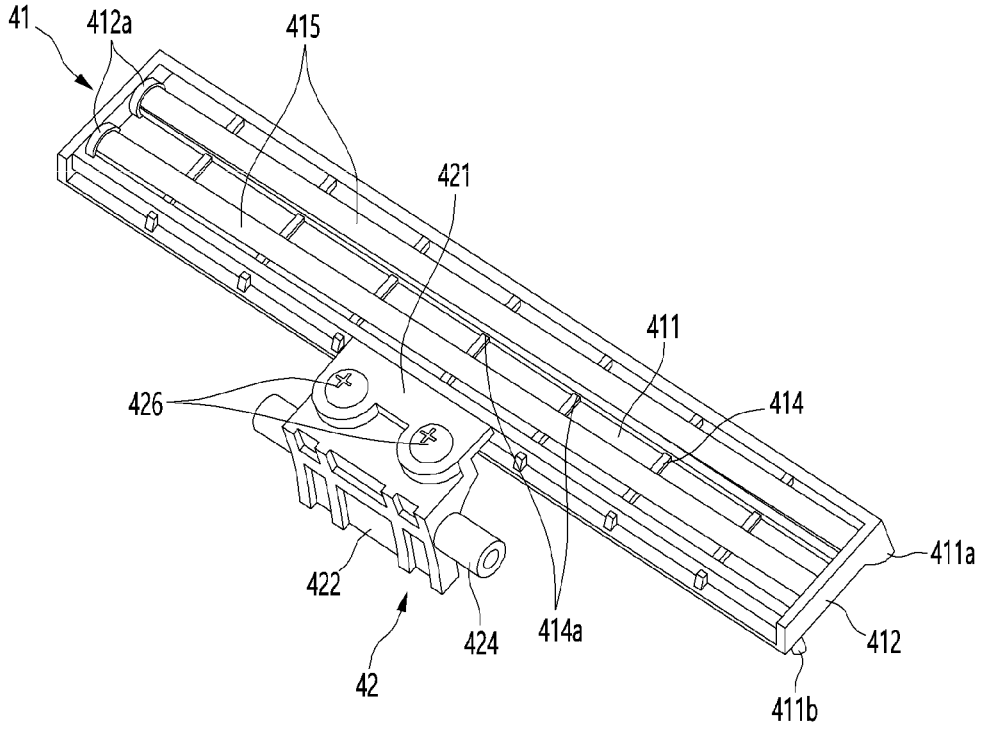
FIG. 17 is a perspective view illustrating the operating member of the door opening device according to the third embodiment of the present disclosure viewed from the front.

FIG. 17 is a perspective view illustrating the operating member of the door opening device according to the third embodiment of the present disclosure viewed from the front.

As illustrated, the operating member 41 constituting the door opening device 30 according to the third embodiment of the present disclosure may include an operating portion 411 providing a surface for a user to operate. The operating portion 411 may be exposed through the handle opening 253 and may shield the handle opening 253. In addition, an upper protrusion 411*a* and a lower protrusion 411*b* may be respectively formed on the rear surface of the operating portion 411.

An operating portion edge 412 protruding forward along the circumference of the operating portion 411 may be formed. In addition, a plurality of reinforcing ribs 414 may be disposed on the front surface of the operating portion.

In addition, a supporter 415 may be provided on the operating portion 411. The supporter 415 may be provided on the front surface of the operating portion 411. The supporter 415 is to reinforce the strength of the operating portion 411 and may be formed in a bar shape crossing the operating portion 411. For example, the supporter 415 may be formed of a metal material. In addition, the supporter 415 may be formed in a round bar shape.

The supporter 415 may have a length corresponding to the horizontal length of the operating portion 411. Both left and right ends of the supporter 415 may be fixed to both ends of the operating portion 411. In detail, both ends of the supporter 415 may be fixed to the operating portion edge 412. A supporter fixing portion 412*a* into which an end portion of the supporter 415 is inserted may be recessed in the operating portion edge 412.

Meanwhile, a recessed supporter groove 414*a* may be formed in a portion of the reinforcing rib 414 through which the supporter 415 passes. An outer surface of the supporter 415 may be supported by the supporter groove 414*a*. Accordingly, the supporter 415 can be stably fixed by the operating portion edge 412 and the reinforcing rib 414.

In addition, a plurality of supporters 415 may be provided and may be spaced apart in the vertical direction.

Meanwhile, the operating member coupling portion 413 may be formed extending downward at the lower end of the operating unit 411. In addition, the second link 42 may be mounted on the operating member coupling portion 413. The second link 42 may be coupled to the operating member coupling portion 413 by a screw 426.

The second link 42 may include a third part 421, a fourth part 422, and a second link rotation shaft 424. Therefore, in a state where the second link 42 is coupled to the operating member 41, the second link 42 can be rotated together with the operating member 41, and the second link rotation shaft 424 may be a rotation shaft of the operating member 41.

When the operating member 41 is operated, the second link 42 is rotated together to rotate the first link 33, and the rotation of the first link 33 pushes the push member 34 to be protrude backward and thus to facilitate opening of the freezing chamber door 22.

Various other embodiments of the present disclosure may be possible in addition to the above-described embodiments. A fourth embodiment of the present disclosure is characterized in that a supporter having a different structure is provided to the operating member of the door opening device. In the fourth embodiment of the present disclosure, other components except for the operating member and the supporter are the same as those of the previous embodiment, and the detailed description and illustration of the same components are omitted and the same reference numerals are used to denote the same components.

Figure 18:
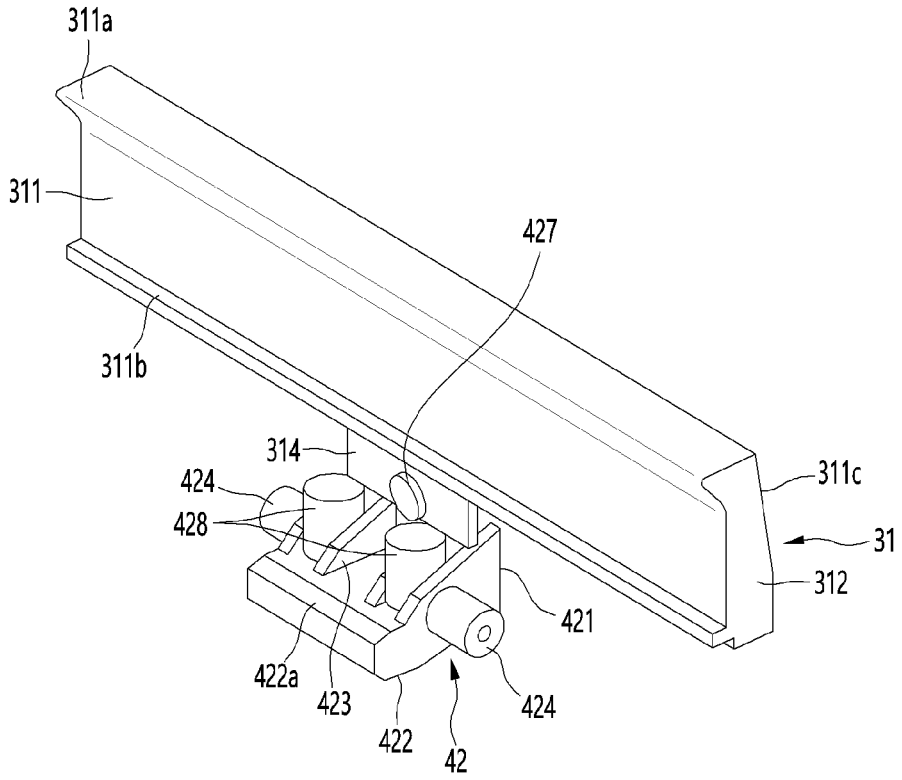
FIG. 18 is a perspective view illustrating the operating member of the door opening device according to the fourth embodiment of the present disclosure viewed from the rear.
Figure 19:
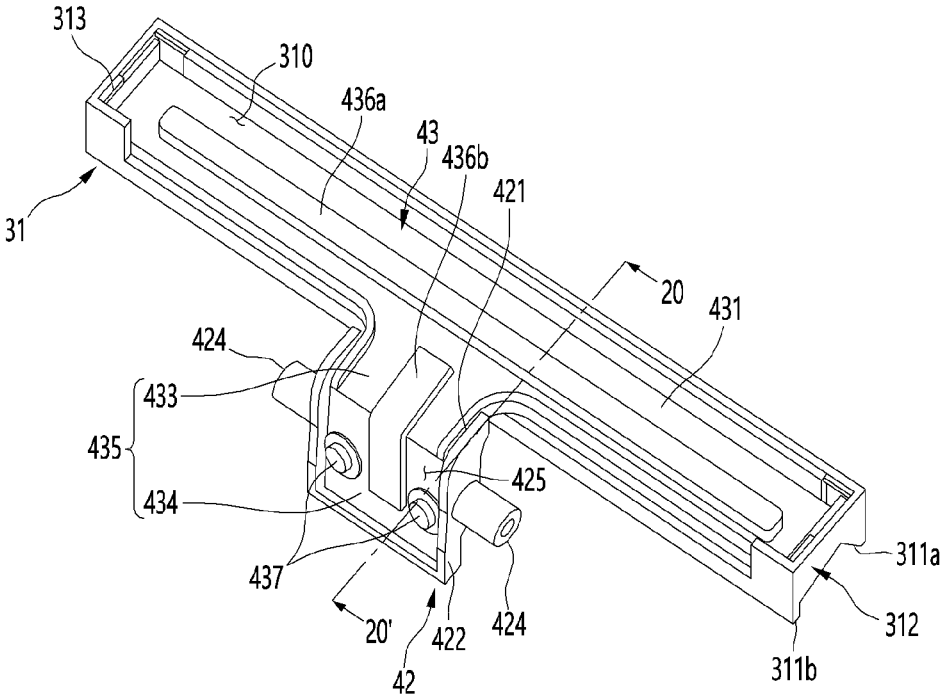
FIG. 19 is a perspective view illustrating the operating member viewed from the front.
Figure 20:
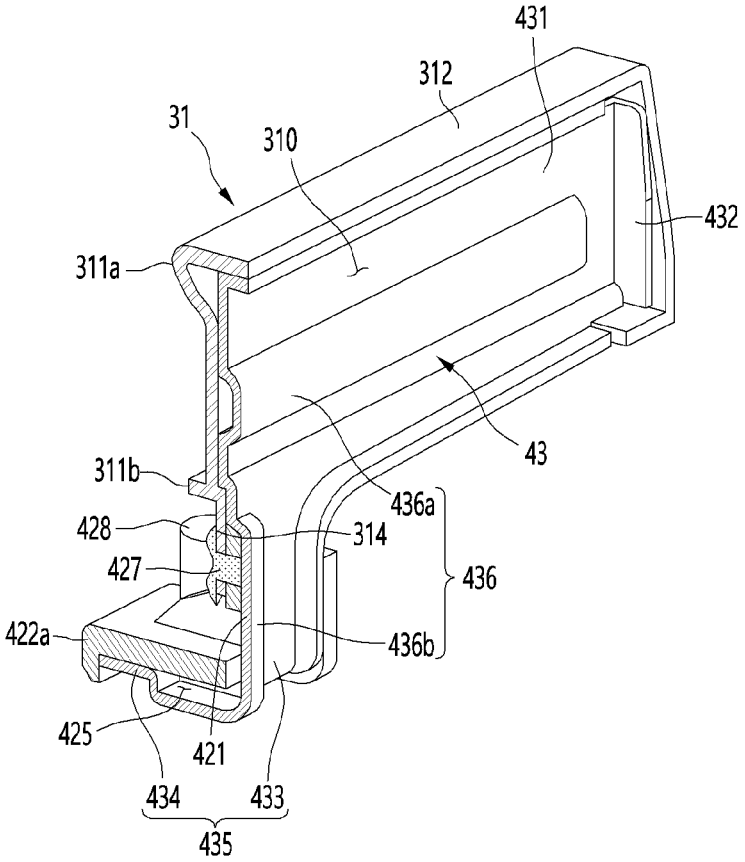
FIG. 20 is a cutaway perspective view taken along line 20-20 of FIG. 19.

FIG. 18 is a perspective view illustrating the operating member of the door opening device according to the fourth embodiment of the present disclosure viewed from the rear, FIG. 19 is a perspective view illustrating the operating member viewed from the front, and FIG. 20 is a cutaway perspective view taken along line 20-20 of FIG. 19.

As illustrated, the operating member 31 constituting the door opening device 30 according to the fourth embodiment of the present disclosure may include an operating portion 311 providing a surface for a user to operate. The operating portion 311 may be exposed through the handle opening 253 and may shield the handle opening 253. In addition, an upper protrusion 311*a* and a lower protrusion 311*b* may be respectively formed on the rear surface of the operating portion 311.

In addition, along the circumference of the operating portion 311, an operating portion edge 312 protruding forward may be formed. In addition, a supporter accommodation portion 310 accommodating a supporter 43 to be described below may be formed inside the operating portion edge 312. In addition, a restraining protrusion 313 for restraining the supporter 43 accommodated in the supporter accommodation portion 310 may be formed on the operating portion edge 312.

An operating member coupling portion 314 extending downward may be formed at the lower center of the operating portion 311. The second link 42 may be mounted to the operating member coupling portion 314. The second link 42 may be referred to as an operating member link. For example, the second link 42 may be coupled to the operating member coupling portion 314 by a screw 427. By fastening the screw 427, the second link 42 can be rotated together with the operating member 31. If necessary, the second link 42 and the operating member 31 may be molded into a single structure.

The second link 42 may include a third part 421, a fourth part 422, and a second link rotation shaft 424. The third part 421 extends upward and may be coupled to the operating member coupling portion 314 by a screw 427. In addition, the fourth part 422 may extend rearward from the lower end of the third part 421 to contact the first link 33.

In addition, a recessed portion 425 may be formed on a lower surface of the fourth part 422, and a lower portion of the supporter 43 may be accommodated in the recessed portion 425. Further, a fastening portion 428 to which a screw 437 for fixing the supporter 43 is fastened may be further formed on the fourth part 422, a pair of fastening parts 428 may be formed, and a pair of screws 437 penetrating the supporter 43 may be respectively fastened. In addition, the fourth part contact portion 422*a* may be formed at the front end of the fourth part 422.

The second link rotation shaft 424 may protrude laterally from both side surfaces of the fourth part 422. In a state where the second link 42 is coupled to the operating member 41, the second link 42 can be rotated together with the operating member 41, and the second link rotation shaft 424 may be a rotation shaft of the operating member 41.

When the operating member 41 is operated, the second link 42 rotates together to rotate the first link 33, and the rotation of the first link 33 causes the push member 34 to protrude backward to assist in opening the freezing chamber door 22.

Meanwhile, the operating member 31 may be supported by the supporter 43 and strength may be reinforced. Further, the supporter 43 may further reinforce strength by further supporting the second link 42. The supporter 43 may be formed to contact the front surface of the operating portion 311 and the lower surface of the second link 42. The supporter 43 may be formed of a material having higher strength than the operating member 31 and the second link 42. For example, the supporter 43 may be formed of a metal material.

The supporter 43 may include a first support portion 431 supporting the operating member 31 and a second support portion 435 supporting the second link 42. The supporter 43 may be formed of a plate-shaped steel material having excellent strength and excellent formability. The supporter 43 may be formed by sheet metal. In addition, a forming portion 436 is formed in the supporter 43 to increase the strength of the plate-shaped supporter 43. In addition, a supporter edge 432 bent forward along the circumference of the supporter 43 may be formed. The supporter edge 432 may be formed along at least a portion of the circumference of the supporter 43, and the strength of the supporter 43 may be further increased.

In detail, the first support portion 431 may extend in a horizontal direction and may be disposed on the front surface of the operating portion 311. The first support portion 431 may be formed in a size corresponding to that of the operating portion 311 and may be accommodated inside the supporter accommodation portion 310. In addition, the first support portion 431 can stably support and reinforce the operating portion 311 by being in surface contact with the front surface of the operating portion 311. The first support portion 431 may be attached to the first support portion 431 by an adhesive member. For example, the adhesive member may be double-sided tape.

In addition, a first forming portion 436*a* may be formed in the first support portion 431. The first forming portion 436*a* may extend along the extension direction of the first support portion 431 and may protrude forward. The first forming portion 436*a* may extend from the left side to the right side of the first support portion 431.

The second support portion 435 may support the second link 42 from below. The second support portion 435 may protrude downward from the center of the first support portion 431. In addition, the second support portion 435 may be integrally molded with the first support portion 431.

The second support portion 435 may include an upper portion 433 and a support portion lower portion 434. The upper portion 433 of the support portion extends downward from the center of the first support portion 431 and may come into contact with the operating member coupling portion 314. Therefore, the upper portion 433 of the support portion can reinforce the strength of the portion of the operating member coupling portion 314. That is, the supporter 43 can reinforce the strength of not only the operating portion 311 but also the control member coupling portion 314 where a load can be concentrated when the operating member 31 is operated.

In addition, the support portion lower portion 434 may be bent backward from the lower end of the support portion upper portion 433 and may support the second link 42 from below. The support portion lower portion 434 may come into contact with the lower surface of the fourth part 422. The support portion lower portion 434 may have a size corresponding to that of the fourth part 422. In addition, the support portion lower portion 434 may be accommodated inside the recessed portion 425 of the fourth part 422 and may come into close contact with the lower surface of the fourth part 422. Accordingly, the support portion lower part 434 supports the second link 42 from below and reinforces the strength of the second link 42.

A second forming portion 436*b* extending along the center of the second support portion 435 may be formed in the second support portion 435. The second forming portion 436*b* may be formed over the support portion upper portion 433 and the support portion lower portion 434. Therefore, the overall strength of the second support portion 435 can be further reinforced.

Meanwhile, a pair of screws 437 may be fastened to the support portion lower portion 434, and the screw 437 may pass through the support portion lower part 434 and be fastened to the fourth part 422. The supporter 43 is firmly coupled to the second link 42 by fastening the screw 437 and may also be constrained to the operating member 31.

Strength of both the operating member 31 and the second link 42 may be reinforced by the coupling of the supporter 43. In addition, the supporter 43 having a single structure supports the operating member 31 and the second link 42, thereby ensuring a firm coupling between the operating member 31 and the second link 42.

What is claimed is:

1. A refrigerator comprising:

a cabinet having a storage space;

a door configured to open and close the storage space, the door including:

an insulator located within the door;

a cap decoration defining at least a portion of a perimeter of the door, the cap decoration having:

a recessed handle; and a handle opening configured to penetrate one surface of the handle;

a door opening device provided on the door, the door opening device being configured to be operated by a user to open the door, the door opening device including:

a case mounted on the cap decoration, the case defining a space independent of the insulator and inside the door, the space being configured to communicate with the handle through the handle opening;

an operating member operably mounted in the space of the case, the operating member passing through the handle opening and extending into the handle;

a push member configured to move relative to a rear of the door to press a front surface of the cabinet;

an elastic member elastically supporting the push member;

a link in contact with the operating member and the push member to operate the push member when the operating member is operated; and a supporter coupled to a front surface of the operating member, the supporter being formed of a material having a higher strength than a material of the operating member to reinforce the operating member, the supporter including:

a supporter body configured to support the front surface of the operating member;

a supporter rotation shaft protruding from the supporter body to be rotatably coupled to the case; and a supporter extension extending rearward beyond the supporter rotation shaft to contact the link such that the supporter extension rotates the link when the operating member is rotated.

2. The refrigerator of claim 1, wherein the door further includes a door plate defining a front surface of the door, and wherein the operating member is located behind the door plate.

3. The refrigerator of claim 1, wherein the operating member is located forward of a center of the handle.

4. The refrigerator of claim 1, wherein the operating member is configured to be manipulated such that a portion of the operating member moves closer to a front surface of the door while opening the door.

5. The refrigerator of claim 1, wherein the handle opening is open toward a front surface of the door and a bottom surface of the door.

6. The refrigerator of claim 1, wherein the operating member is configured to block the handle opening.

7. The refrigerator of claim 1, wherein the operating member is rotatably provided at the case, and wherein, when the operating member is rotated towards a front of the door, the operating member moves into the handle opening.

8. The refrigerator of claim 1, wherein the operating member, the elastic member, the link and the push member are mounted inside the case.

9. The refrigerator of claim 8, wherein the operating member includes a rotation shaft rotatably provided at the case, wherein the link includes a rotation shaft rotatably provided at the case, and wherein the rotation shaft of the operating member and the rotation shaft of the link are located adjacent to each other.

10. The refrigerator of claim 1, wherein a rear surface of the operating member is exposed to an inside of the handle.

11. The refrigerator of claim 1, wherein the supporter body includes a plurality of reinforcing ribs on the supporter body, the reinforcing ribs being arranged to cross each other.

12. The refrigerator of claim 10, wherein the supporter has a rod shape and extends from a first end of the operating member to a second end of the operating member in a longitudinal direction of the operating member.

13. The refrigerator of claim 10, wherein the supporter has a plate shape corresponding to the front surface of the operating member to support the front surface of the operating member.

14. The refrigerator of claim 1, wherein the link includes:

a first link rotatably coupled to the case, the first link being configured to move the push member in response to rotation of the first link; and a second link coupled to the operating member, the second link being configured to contact the first link to transfer rotational force of the operating member to the first link.

15. The refrigerator of claim 14, wherein the supporter extension extends from a lower end of the supporter body, the supporter extension being configured to support a lower surface of the second link.

16. The refrigerator of claim 15, wherein the supporter further includes a recessed portion extending in an extension direction of at least one of the supporter body and the supporter extension.

17. The refrigerator of claim 1, further comprising a rail connecting the cabinet and the door to allow the door to be drawn in and out of the storage space of the cabinet.

18. The refrigerator of claim 1, further comprising a hinge connecting the door to the cabinet to rotatably support the door.

* * * * *